US012708198B1

(12) United States Patent
Hernandez

(10) Patent No.: US 12,708,198 B1
(45) **Date of Patent: *Aug. 18, 2026**

(54) MOVABLE DESK WITH ADJUSTABLE LIFT AND TILT

(71) Applicant: Victor Hugo Hernandez, Huntington Beach, CA (US)

(72) Inventor: Victor Hugo Hernandez, Huntington Beach, CA (US)

( * ) Notice: Subject to any disclaimer, the term of this patent is extended or adjusted under 35 U.S.C. 154(b) by 331 days.

This patent is subject to a terminal disclaimer.

(21) Appl. No.: 18/480,905

(22) Filed: Oct. 4, 2023

Related U.S. Application Data

(63) Continuation-in-part of application No. 18/080,220, filed on Dec. 13, 2022, now Pat. No. 11,779,107.

(51) Int. Cl.
*A47B 13/08* (2006.01)
*A47B 5/06* (2006.01)
*A47B 21/02* (2006.01)

(52) U.S. Cl.
CPC ..... *A47B 13/081* (2013.01); *A47B 5/06* (2013.01); *A47B 21/02* (2013.01)

(58) Field of Classification Search
CPC ..... A47B 13/081; A47B 5/06; A47B 9/00; A47B 9/02; A47B 2200/0042; A47B 2200/0066; A47B 21/02; A47B 21/00; A47B 27/18
USPC ..... 108/2, 6, 7, 11, 10, 50.01
See application file for complete search history.

(56) References Cited

U.S. PATENT DOCUMENTS

| | | | | |
|---|---|---|---|---|
| 5,778,799 | A * | 7/1998 | Eyre | A47B 21/0314 108/50.01 |
| 5,823,120 | A * | 10/1998 | Holmquist | A47B 9/02 108/147 |
| 6,038,986 | A * | 3/2000 | Ransil | A47B 17/02 108/146 |
| 6,644,748 | B2 * | 11/2003 | Tholkes | A47B 9/00 297/423.12 |
| 6,721,178 | B1 * | 4/2004 | Clark | A47B 21/00 361/679.44 |
| 8,065,966 | B1 * | 11/2011 | Bacon | A47B 9/16 108/147 |
| 8,789,474 | B2 * | 7/2014 | Kim | A47B 41/02 108/50.01 |
| 9,612,849 | B1 * | 4/2017 | Gildein, II | G06F 9/44505 |
| 9,687,100 | B2 * | 6/2017 | McMahan | A47G 27/0212 |
| 10,295,311 | B1 * | 5/2019 | Trubacek | A47B 37/00 |
| 11,779,107 | B1 * | 10/2023 | Hernandez | A47B 13/081 108/2 |
| 2007/0266912 | A1 * | 11/2007 | Swain | A47B 9/02 108/145 |
| 2017/0135587 | A1 * | 5/2017 | Desroches | A61B 5/01 |
| 2018/0279770 | A1 * | 10/2018 | Crowe | A47B 9/10 |
| 2019/0328128 | A1 * | 10/2019 | Namala | A47B 9/20 |
| 2019/0328129 | A1 * | 10/2019 | Namala | A47B 9/20 |

(Continued)

*Primary Examiner* — Jose V Chen
(74) *Attorney, Agent, or Firm* — Staniford Tomita LLP

(57) ABSTRACT

A movable desk includes an adjustable desktop, a vertical actuator for adjusting a vertical position of the adjustable desktop, wheel assemblies and a controller. Each of the wheel assemblies has an omnidirectional wheel and a motor coupled to the omnidirectional wheel, wherein the controller communicates with the vertical actuator and the motors of the wheel assemblies for controlling movements of the vertical actuator and the wheel assemblies.

20 Claims, 22 Drawing Sheets

(56) References Cited

U.S. PATENT DOCUMENTS

| | | | | |
|---|---|---|---|---|
| 2019/0392722 | A1* | 12/2019 | Commissariat | A47B 21/02 |
| 2020/0104762 | A1* | 4/2020 | Gibson | H04W 4/80 |
| 2020/0170407 | A1* | 6/2020 | Knapp | A47B 9/00 |
| 2025/0143449 | A1* | 5/2025 | Douglas | A47B 13/088 |

* cited by examiner

MOVABLE DESK WITH ADJUSTABLE LIFT AND TILT

CROSS-REFERENCE TO RELATED APPLICATIONS

This application claims priority to U.S. patent application Ser. No. 18/080,220, titled "Movable Desk With Adjustable Lift And Tilt" filed Dec. 13, 2022 which is now U.S. Pat. No. 11,779,107. U.S. patent application Ser. No. 18/080,220 is hereby incorporated by reference in its entirety.

FIELD OF THE INVENTION

The invention relates to an electrically lifted and tilted computer desk and office desk thereof which can be used separately or in combination using a single or a double-rail stem and can be lifted stably with low noise and great bearing power.

BACKGROUND OF THE INVENTION

With the generalization of digital homes and many companies participating in remote location work life, the household life of people are going through enormous changes, wherein the incorporation of digital automation design in modern homes is the outstanding advantage. In these household environments, the desk has become incorporated into human lives with multiple functions. Various drawbacks to existing adjustable height desks include the lack of variability in single angled desks which cannot be adjusted in height and angle to suit persons of various sizes, limited capabilities for storage and storing, and a general immobility of the desk apparatus itself (NAME) discloses such desktop device in order to solve the aforementioned problems.

Many companies are now allowing workers to work from home which results in a large change in the home to accommodate workers. Many workers are adjusting their home offices to incorporate digital automation design to improve their health and productivity. In these household work environments, the work desk has become incorporated into human lives with multiple functions. However, existing work desks have various drawbacks including the lack of range in the adjustable height and a lack of variability in desktop angle. These fixed angle desktops cannot be adjusted in both the desired height and angle over a wide range to suit people of various sizes, limited capabilities. These desks may also be large and difficult to store when the user is not working. What is needed is a design that is adjustable in both a wide range of lift and tilt angles that can also be configured to occupy a small area for storage.

SUMMARY OF THE INVENTION

An objective of the present invention to provide a desk which is capable of solving the limitations of other adjustable height desks. The inventive desk can both tilt and raise the desktop over a wide range of movements. In some embodiments, the desktop of the desk may tilt from 0 degrees (horizontal) to 70 degrees (angled downward) and a desktop height can be variable between 2 to 4.5 feet from the floor surface. With the desktop angled downward, the desk can occupy and be stored on less floor space than a desk with a horizontal desktop.

In an embodiment, the inventive desk can have: a desktop, tilt plates coupled to the desktop, and vertical members that support the desktop. The desktop can be moved vertically with vertical actuators and the angle of the desktop can be adjusted with tilt actuators. The vertical members can each have an elongated vertical groove and the tilt plates can each have bears that slide within the elongated vertical grooves. The bearings slide vertically within the grooves in the vertical members allowing the desktop to be smoothly lowered and raised with low friction. The bearings also allow the angle of the desktop can be smoothly adjusted with low friction.

The desk can also have an upper shelf unit that may be attached to the grooves of the vertical members above the desktop. In a first configuration, the upper shelf unit may move vertically with the desktop. In a second configuration, the upper shelf unit may be locked in place at a desired vertical position on the vertical members.

The desk may be stored easier by the desktop's ability to be angled downward at 45 degrees or more. At this lowered angle the desk occupies less floor area and therefore allows for more compact storage. The foregoing objectives, features, functions, and advantages of the present invention will be more readily understood upon a thoughtful deliberation of the following detailed description of the present invention with reference to the accompanying drawings.

DETAILED DESCRIPTION OF THE INVENTION

The invention relates to a desk that is adjustable to variable heights and desktop angles. In particular, the invention relates to an adjustable desk that can be moved between a sitting position and a standing position as well as being movable in tilt angle in the sitting and standing positions. Moreover, the invention relates to an adjustable desk that offers ease in height adjustment, desktop angle adjustment, movability, and storage, while also providing a user with an ergonomic work environment in order to improve the health and comfort of a user. Therefore, the invention has the advantages of stable lifting and tilting, and great powered movement.

Figure 1:
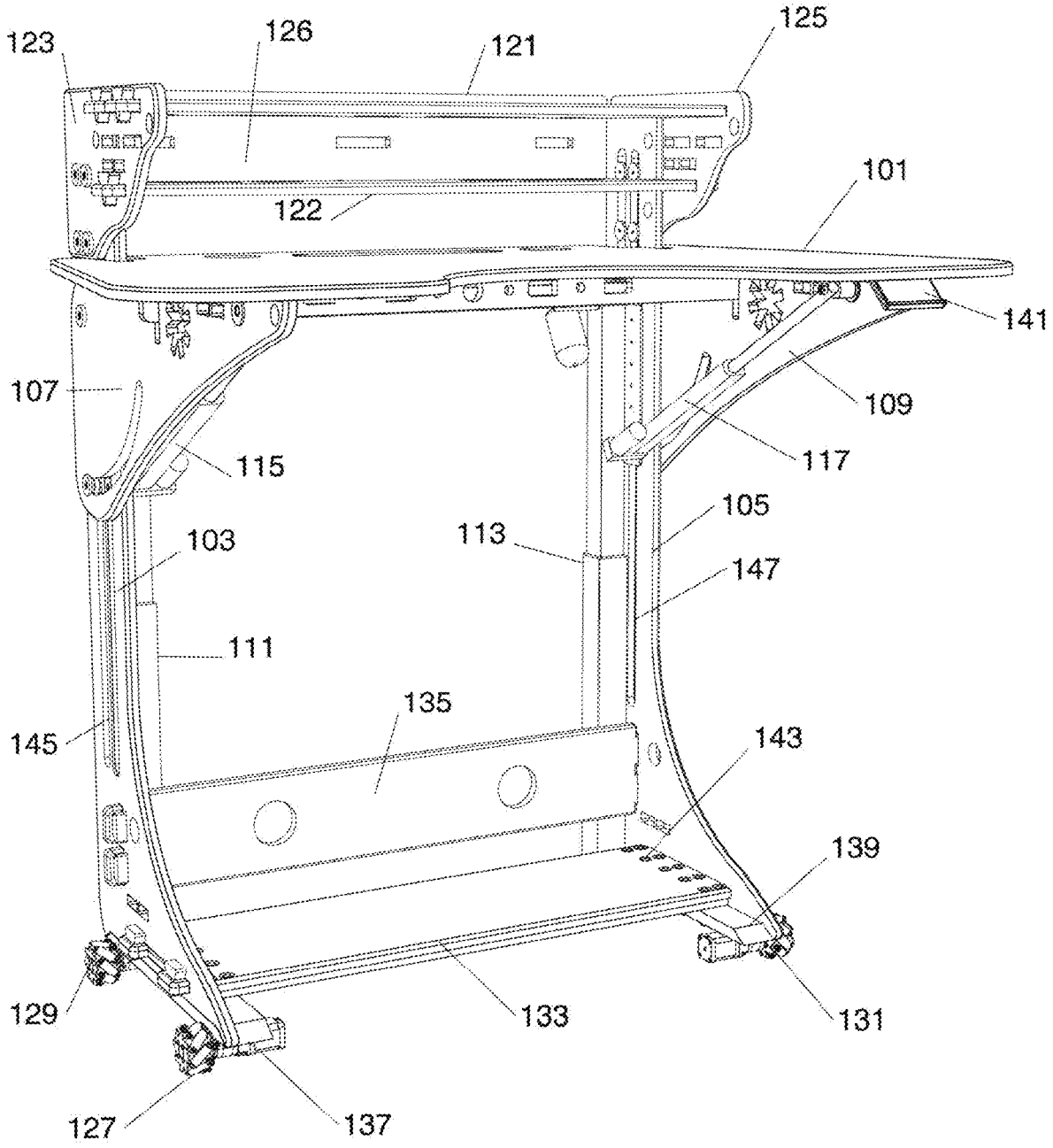
FIG. 1 is a front perspective view of an embodiment of the adjustable desk invention.

With reference to FIG. 1, an embodiment of the inventive desk 100 is illustrated. The inventive desk 100 comprises: an adjustable desktop 101, a first tilt plate 107, a second tilt plate 109, a first vertical member 103, a second vertical member 105, a first vertical actuator 111, a second vertical actuator 113, a first tilt actuator 115, and a second tilt actuator 117. The first vertical member 103 is coupled to the first tilt plate 107 at a first pivot point in first vertical member 151 on a rear portion of the first tilt plate 107 and the second vertical member 105 is coupled to the second tilt plate 109 on a rear portion of the second tilt plate 109. The first vertical actuator 111 is coupled to the first tilt plate 107 and the second vertical actuator 113 is coupled to the second tilt plate 109. The first vertical actuator 111 and the second vertical actuator 113 are extendable and retractable to move the first tilt plate 107, the second tilt plate 109, and the desktop 101 vertically. The first tilt actuator 115 is coupled to a front portion of the first tilt plate 107 and the second tilt actuator 117 coupled to a front portion of the second tilt plate 109. The first tilt actuator 115 and the second tilt actuator 117 are also extendable and retractable to change the tilt angle of the first tilt plate 107, the second tilt plate 109, and the desktop 101.

The first vertical actuator 111, the second vertical actuator 113, the first tilt actuator 115, and the second tilt actuator 117 can be coupled to a control unit 141 that can have a user interface. A user can input commands into the user interface so that the control unit 141 can control the movements of the first vertical actuator 111, the second vertical actuator 113, the first tilt actuator 115, and the second tilt actuator 117 which can cause the desktop 101 to move to the desired height and tilt angle.

In some embodiments, the desk 100 can have one or more planar shelves 121, 122. In the illustrated embodiment, an upper shelf assembly can have an upper shelf 121, a lower shelf 122, a first shelf side plate 123, a second shelf side plate 125 and an upper transverse member 126. The upper shelf assembly can be attached to the first vertical member 103 and the second vertical member 105. The upper shelf 121 and the lower shelf 122 can be planar structures that are horizontally oriented and extend across the width of the desk 100. The ends of the upper shelf 121 and the lower shelf 122 can be coupled between the first shelf side plate 123 and the second shelf side plate 125.

The bottoms of the first shelf side plate 123 and the second shelf side plate 125 can rest on a top surface of the desktop 101 and/or the first tilt plate 107 and the second tilt plate 109. In a first configuration, the upper shelf assembly can move vertically with the desktop 100 when the first vertical actuator 111 and the second vertical actuator 113 are extended or retracted. In a second configuration, a locking mechanism can be used to secure the upper shelf assembly to the first vertical member 103 and the second vertical member 105. Thus, the upper shelf assembly can remain in a fixed vertical position relative to the first vertical member 103 and the second vertical member 105 while the desktop 100 moves when the first vertical actuator 111 and the second vertical actuator 113 are extended or retracted.

In some embodiments, the desk 100 can have a bottom shelf 133 that can be mounted between the bottom portions of the first vertical member 103 and the second vertical member 105. The bottom shelf 133 can be a horizontally oriented planar structure. The lower portion of the desk 100 can also have a lower transverse member 135 that is planar and vertically oriented. The lower transverse member 135 can also be mounted between the bottom portions of the first vertical member 103 and the second vertical member 105.

In some embodiments, the desk 100 can have a plurality of wheels 127, 129, 131, 132 that allow the desk 100 to be easily moved across a floor. The wheels 127, 129, 131, 132 can be free rotating and locking so that the desk 100 can be manually moved to a desired position and then the wheels 127, 129, 131, 132 can be locked to prevent rotation so that the desk 100 remains in place. Alternatively, the wheels 127, 129, 131, 132 can be coupled to motors 137 that can be controlled by a control unit 141 to move the desk 100 to a desired location.

Figure 2:
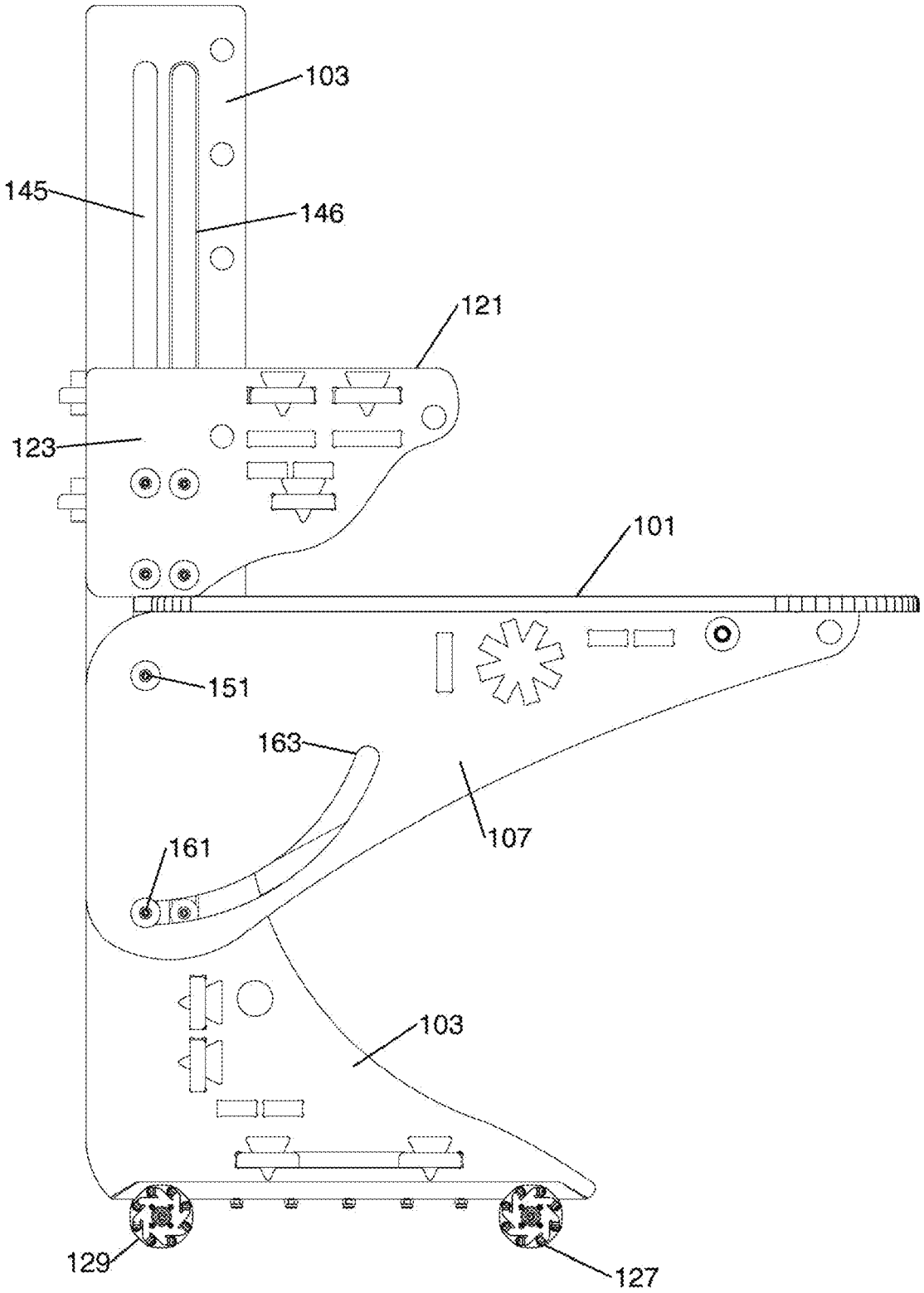
FIG. 2 is a left side view of an embodiment of the adjustable desk invention with the desktop in a horizontal and lowered position with the upper shelf assembly in a lowered position.

With reference to FIG. 2, a side view of an embodiment of the desk 100 with the desktop 101 in a horizontal lowered position is illustrated. In the illustrated embodiment, the vertical actuators have been retracted so that the desktop 101, first tilt plate 107, and the second tilt plate 109 are in a lowered position that may be suitable for seated work. The upper shelf assembly rests on the upper surface of the desktop 101 and has also moved to a lowered position. In different embodiments, the height of the desktop can be adjustable between 2 feet and 4.5 feet from the floor surface. In the illustrated lowered position, the height of the desktop can be 2 feet 5 inches. The first vertical member 103 can have one or two vertical slots 145, 146. While the illustrated embodiment has two vertical slots, in other embodiments, the first vertical member 103 can have a single vertical slot 145. The remaining slot 146 can have pockets for the rail caps that can be connected to the bearings and the vertical members 103, 105.

As discussed, the first tilt plate 107 is coupled to the first vertical member 103. In the illustrated embodiment, a first pivot point in the first vertical member 151 and a first attachment point in vertical member 161 are used to couple the first tilt plate 107 to the first vertical member 103. The desktop 101 and the first tilt plate 107 can rotate about the first pivot point 151. Similarly, the desktop 101 and the second tilt plate can rotate about a second pivot point. The second tilt plate and the second pivot point are not shown in FIG. 2. When the desktop 101, first tilt plate 107, and second tilt plate rotate, the first attachment point 161 can slide within a first arcuate slot 163 and similarly a second attachment point can slide within a second arcuate slot on the right side of the desk.

Figure 3:
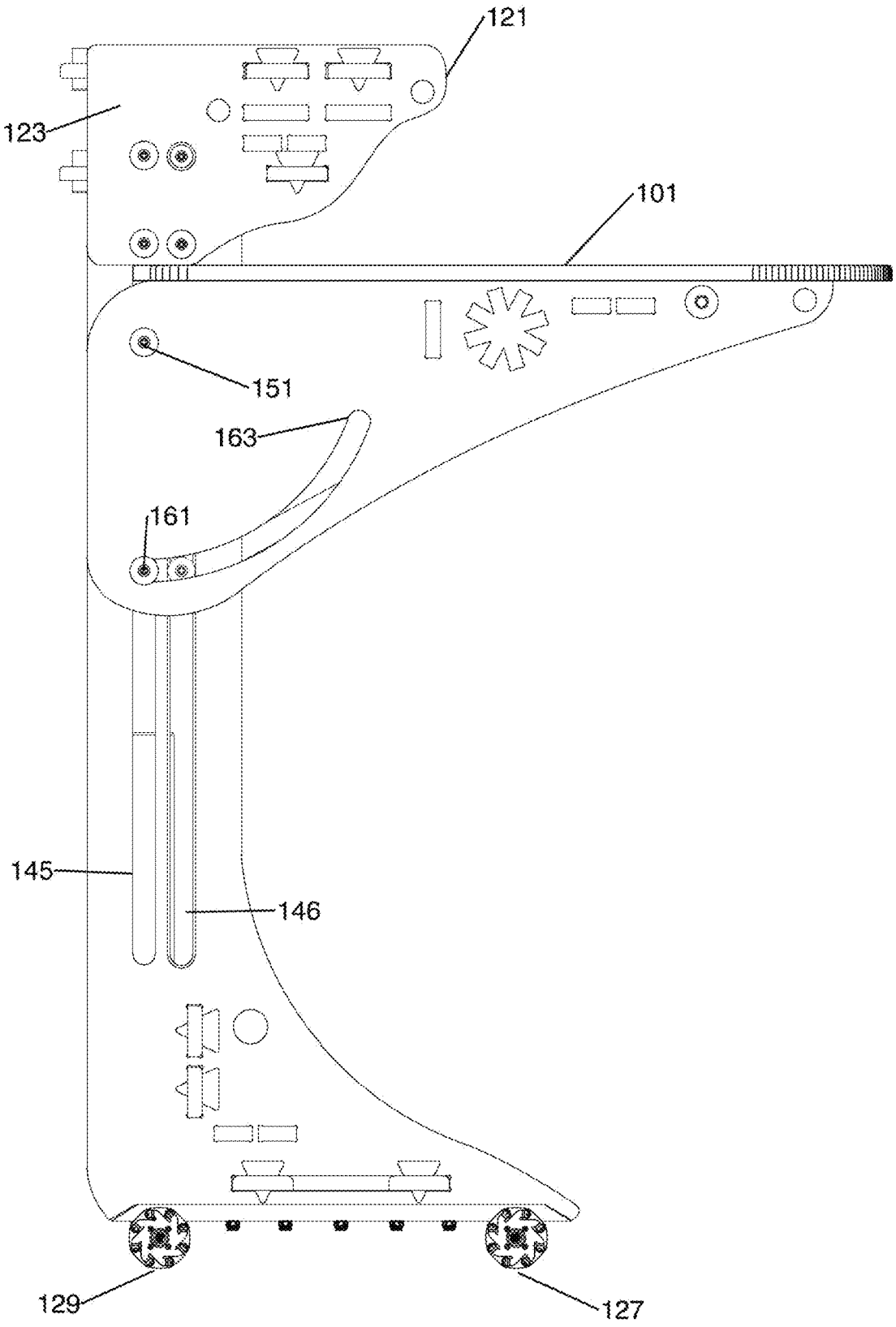
FIG. 3 is a left side view of an embodiment of the adjustable desk invention with the desktop in a horizontal and raised position.

FIG. 3 illustrates a side view of an embodiment of the desk 100 with the desktop 101 in a horizontal and raised or elevated position that may be suitable for standing work. In the illustrated embodiment, the vertical actuators have been extended so that the desktop 101, the first tilt plate 107, and the second tilt plate are in a raised position. The upper shelf assembly rests on the upper surface of the desktop 101 and is also in a raised position. In the illustrated raised position, the height of the desk can be 4 feet 1 inch. In the illustrated raised position, the desk plate can be tilted from 0 to 70 degrees.

Figure 4:
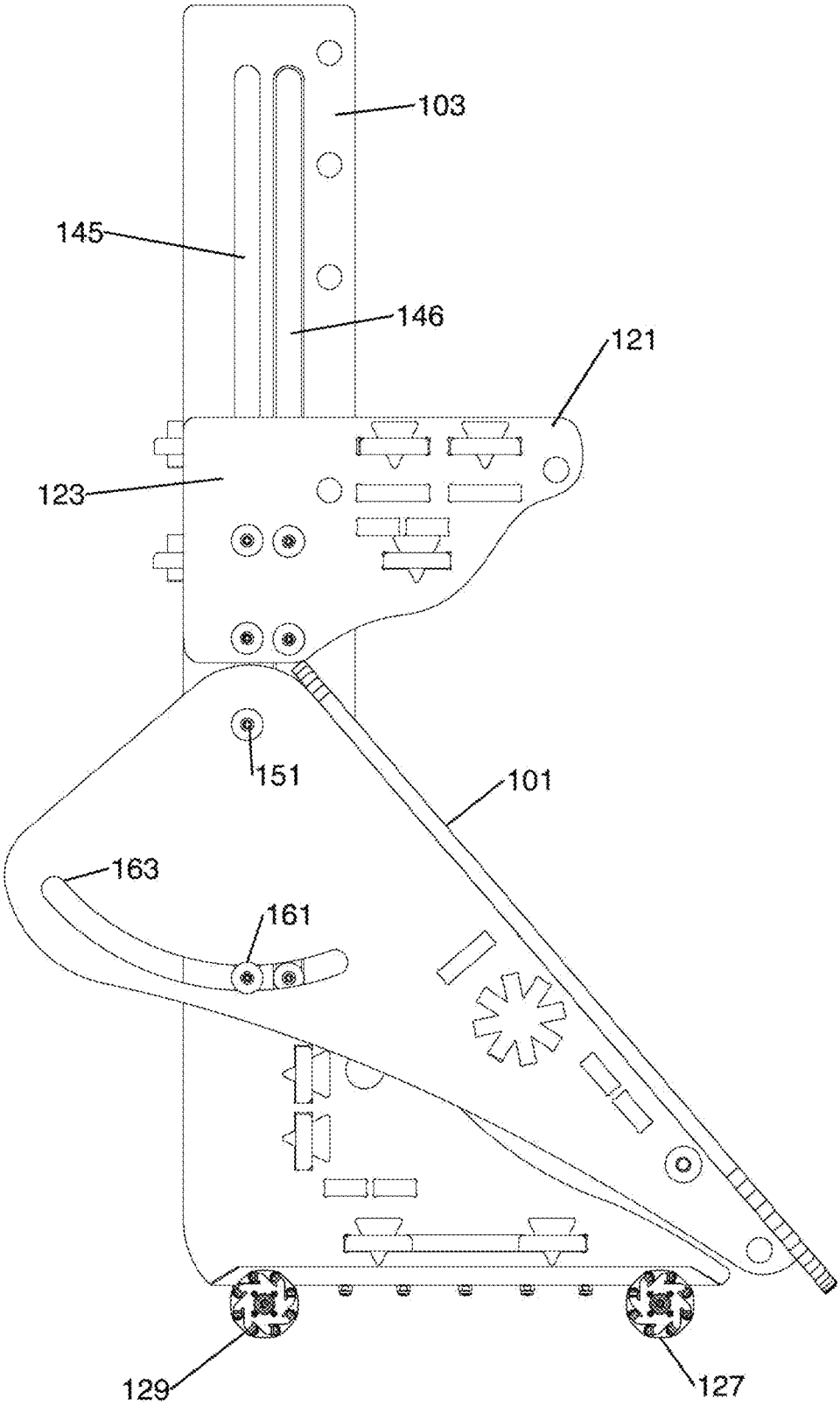
FIG. 4 is a left side view of an embodiment of the adjustable desk invention with the desktop in a tilted and lowered position.

With reference to FIG. 4, a side view of an embodiment of the desk 100 in a lowered and angled position is illustrated. In the illustrated embodiment, the vertical actuators have been retracted so that the desktop 101, first tilt plate 107, and the second tilt plate are in a lowered position. The first tilt actuator and the second tilt actuator have also been retracted so that the desktop 101, the first tilt plate 107, and the second tilt plate are also in a highly angled position. The upper shelf assembly can rest on the upper surface of the desktop 101 and/or rear portions of the first tilt plate 107, the first tilt plate 107, and the second tilt plate so that the upper shelf assembly is also in a lowered position. In this configuration, the desk 100 can occupy less horizontal space which can be useful for storage. In the illustrated lowered position, the desk plate can be tilted from 0 to 50 degrees.

Figure 5:
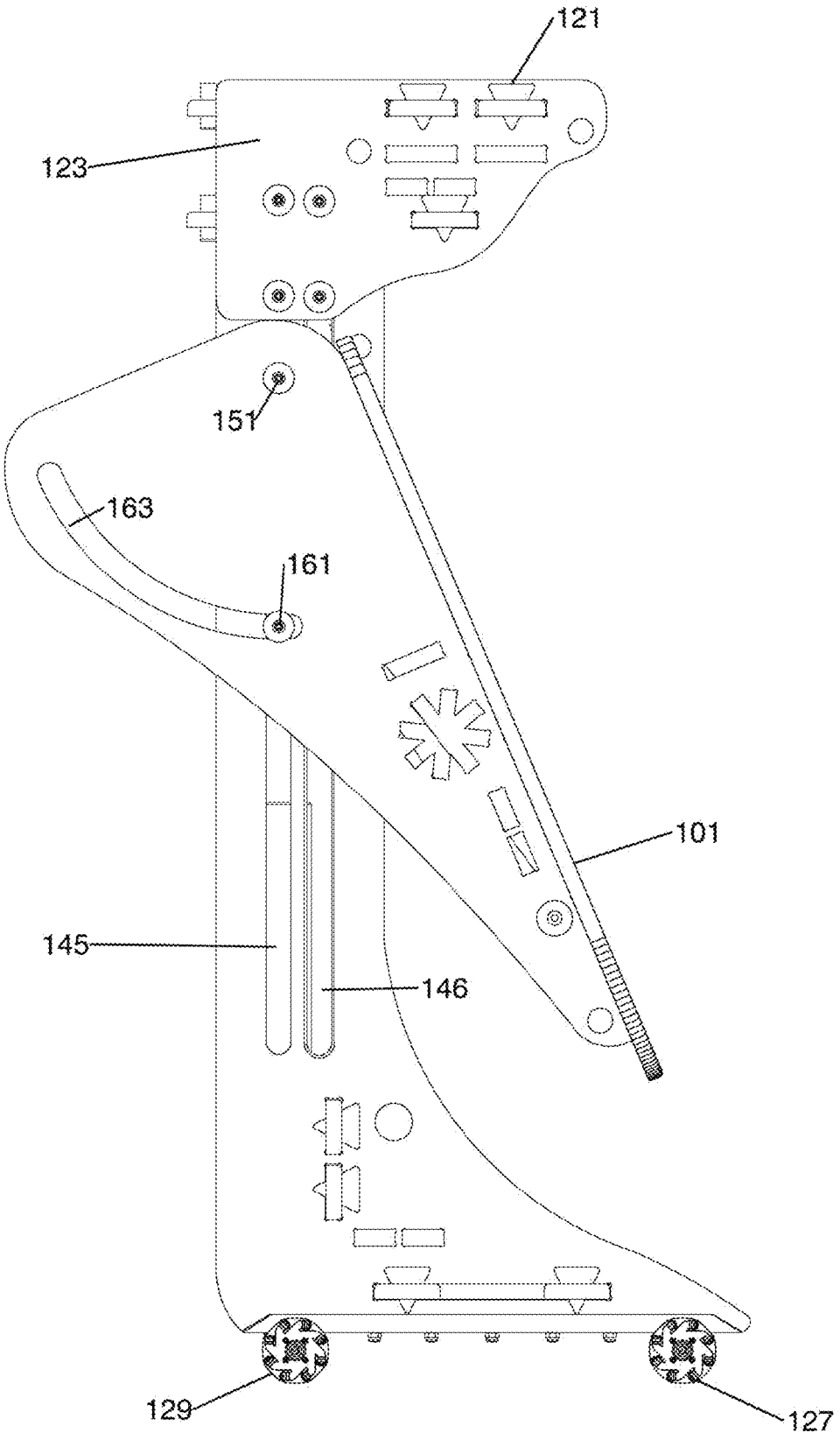
FIG. 5 is a left side view of an embodiment of the adjustable desk invention with the desktop in a tilted and raised position.

With reference to FIG. 5, a side view of an embodiment of the desk 100 in a raised angled position is illustrated. The illustration in FIG. 5 depicts the vertical actuators protracted so that the desktop 101, first tilt plate 107, and the second tilt plate are in a raised position. The first tilt actuator and the second tilt actuator are retracted so that the desktop 101, the first tilt plate 107, and the second tilt plate are in their maximum angled position. The upper shelf assembly rests on the upper surface of the desktop and/or rear portions of the first tilt plate 107, and the second tilt plate so that the upper shelf assembly is also in a raised position. This illustration shows the maximum height that the desktop 101 can be raised to. In this configuration, the desk 100 can occupy less space. In FIG. 5, the first tilt actuator and the second tilt actuator are retracted so that the desktop 101, the first tilt plate 107, and the second tilt plate are in a highly angled position which can be more angled than when the desktop 101 is at its lowest position. In the illustrated raised position, the tilt amble of the desktop 101 can be between 0 to 70 degrees.

Figure 6:
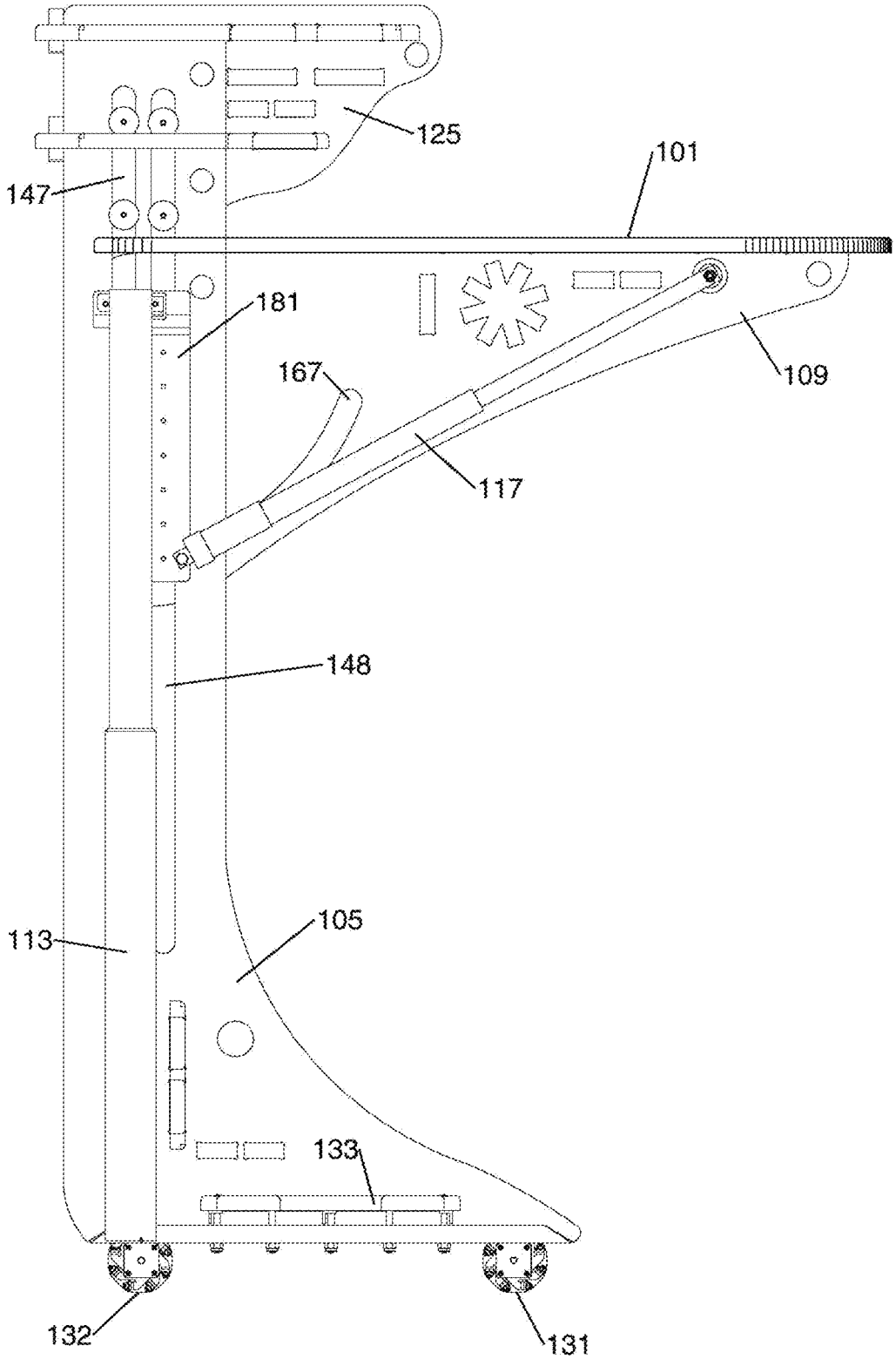
FIG. 6 is a left side view of a right inner portion of an embodiment of the adjustable desk invention with the desktop in a horizontal and raised position.

FIG. 6 is an inside view of the right portion of the desk 100 as shown in FIG. 3. FIG. 6 depicts the vertical actuators 113 as extended so that the desktop 101, first tilt plate (not shown) and the second tilt plate 109 are in a raised and horizontal position. In the illustrated raised position, the height of the desk can be 4 feet 1 inch. In the illustrated embodiment, the top portion of the second vertical actuator 113 is coupled to a second side plate 181. A plurality of bearings can extend from a planar surface of the second side plate 181. The bearings can be positioned within vertical parallel grooves 147, 148 in the first vertical member (not shown) and the second vertical member 105. The bearings allow the second side plate 181 and the second tilt plate 109 to move vertically with minimal friction. The second vertical actuator 113 can be positioned on a first side of the second side plate 181 and the bearings can extend outward from an opposite side of the second side plate 181. The bearings can each have an axis of rotation that is perpendicular to the plane of the second side plate 181. The bearings can also have a cylindrical portion adjacent to the second side plate 181 and a cap portion that has a wider diameter than the cylindrical portion. The cylindrical portion can have a diameter that is smaller than the width of the vertical grooves 147, 148 and the cap portion can have a diameter that is larger than the width of the vertical grooves 147, 148. When assembled the second side plate 181 can move the entire length of the vertical grooves 147, 148 but cannot be separated from the second vertical member 105. While the vertical members have been illustrated with two parallel grooves 147, 148, in other embodiments, the vertical members may each only have a single vertical groove within which the bearing slide.

The second tilt actuator 117 is coupled between a lower portion of the second side plate 181 and a front portion of the second tilt plate 109. These coupling points can be rotational couplings that allow the second tilt actuator 117 to rotate relative to the second side plate 181 and the second tilt plate 109. As the second tilt actuator 117 is retracted, a pivot cap (not shown) will slide within an arcuate slot 167.

Figure 7:
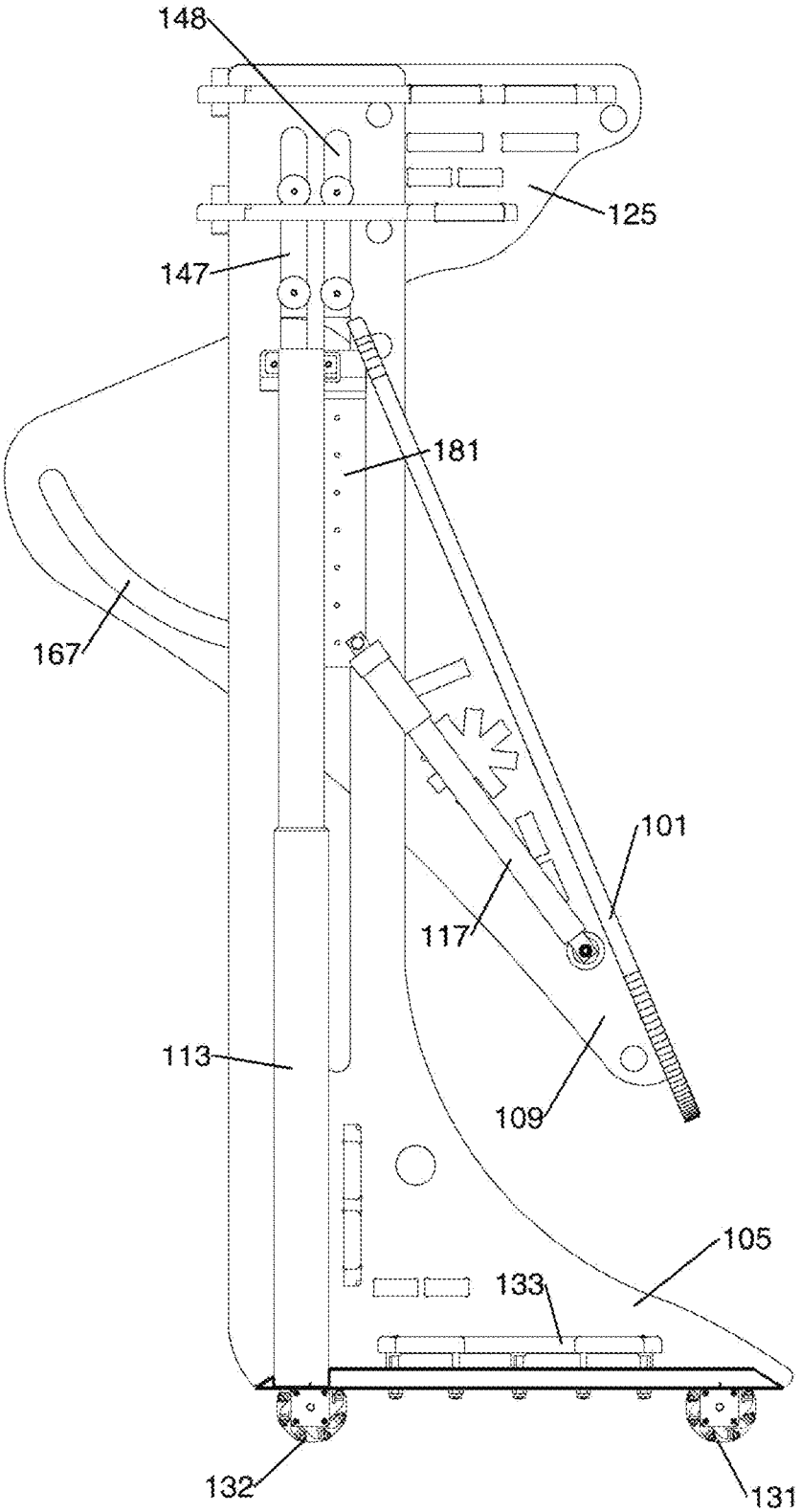
FIG. 7 is a left side view of a right inner portion of an embodiment of the adjustable desk invention with the desktop in a tilted and raised position.

FIG. 7 is an inside view of the second vertical member 105 depicting the tilt actuator 117 retracted so that the desktop 101 and the second tilt plate 109 are in a raised and angled position, as discussed in FIG. 5. The illustration shows the second tilt actuator 117 fully retracted so that the desktop 101, and the second tilt plate 109 are in their maximum angled positions. As discussed, the second tilt plate 109 rotates about a second pivot point and a lower rear portion of the second tilt plate 109 has been moved to extend back beyond a back edge of the second vertical member 105.

Figure 8:
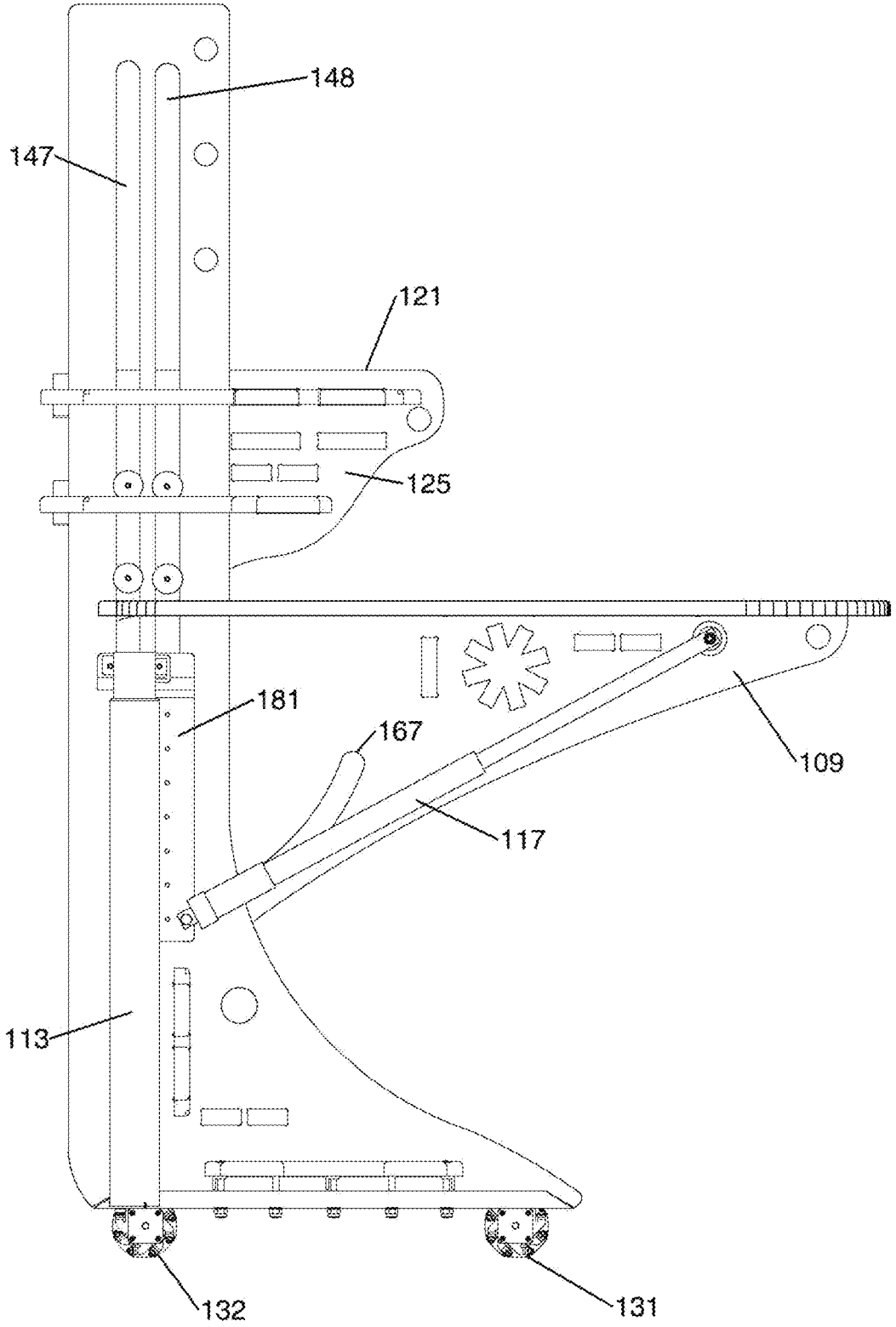
FIG. 8 is a left side view of a right inner portion of an embodiment of the adjustable desk invention with the desktop in a horizontal and lowered position.
Figure 9:
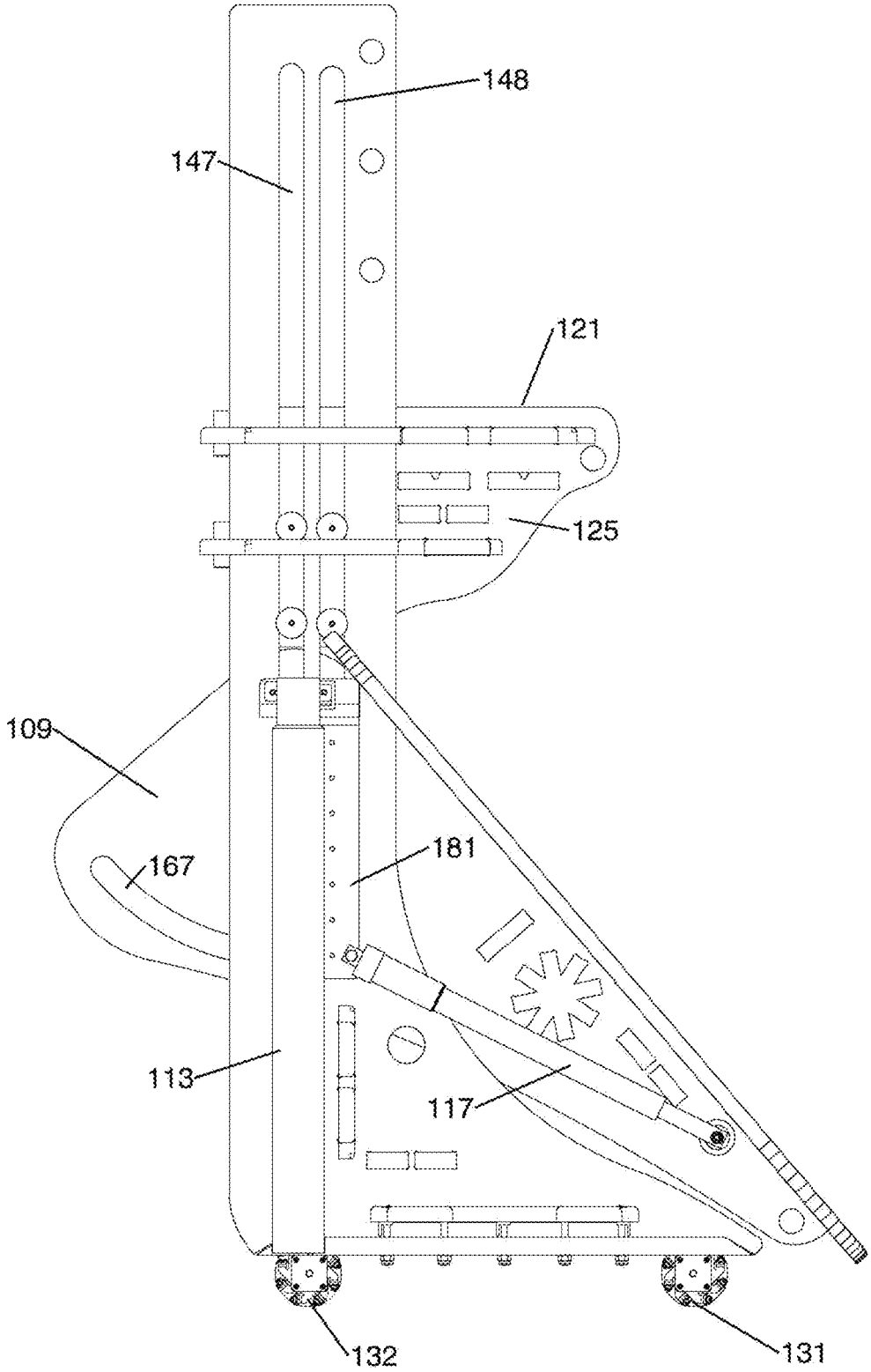
FIG. 9 is a left side view of a right inner portion of an embodiment of the adjustable desk invention with the desktop in a tilted and lowered position.

With reference to FIGS. 8 and 9, an inner right-side view of an embodiment of the desk 100 with the desktop 101 in the lowered position is illustrated. As discussed, the pivot points and the bearing attachment points slide within the vertical grooves 147, 148. In the illustrated embodiments, the vertical grooves 147, 148 is vertically oriented and therefore the pivot points and the attachment points can only move in vertical directions. Therefore when the vertical actuators 113 are fully retracted, the pivot points and the attachment points can slide to the bottom of the vertical grooves 147, 148. Conversely, when the vertical actuators are fully extended, the pivot points and the bearing attachment points can slide to an upper portion of the grooves 147, 148.

With reference to FIGS. 4-9, the upper shelf assembly can also be attached to the vertical slots 147, 148 in the vertical members 105. Bearings 185 can extend inward from the shelf slide plate 125 and allow the upper shelf assembly to smoothly slide up or down in a vertical direction. When the second vertical actuators 113 is fully extended, the shelf bearings 185 can slide to an upper end portion of the slots 147, 148 and when the second vertical actuators 113 is fully retracted, the shelf bearings 185 can slide to a lower portion of the slots 147, 148. In some embodiments, it may be desirable to lock the upper shelf assembly in a fixed position rather than having the shelf move with the desktop 101.

Figure 10:
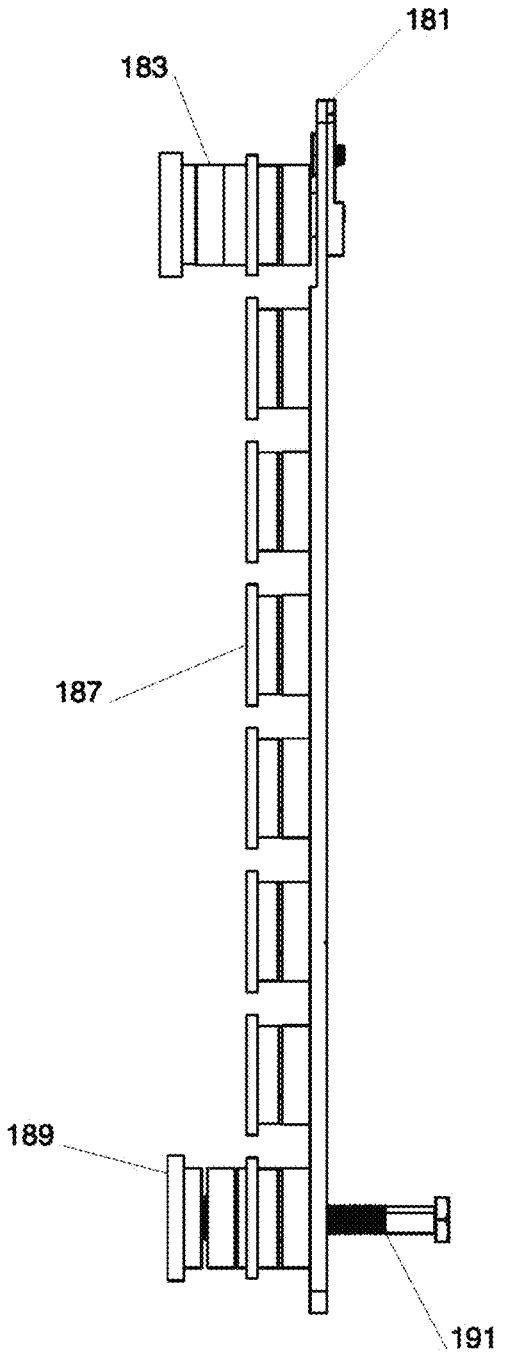
FIG. 10 is a side view of an embodiment of the plate assembly.
Figure 11:
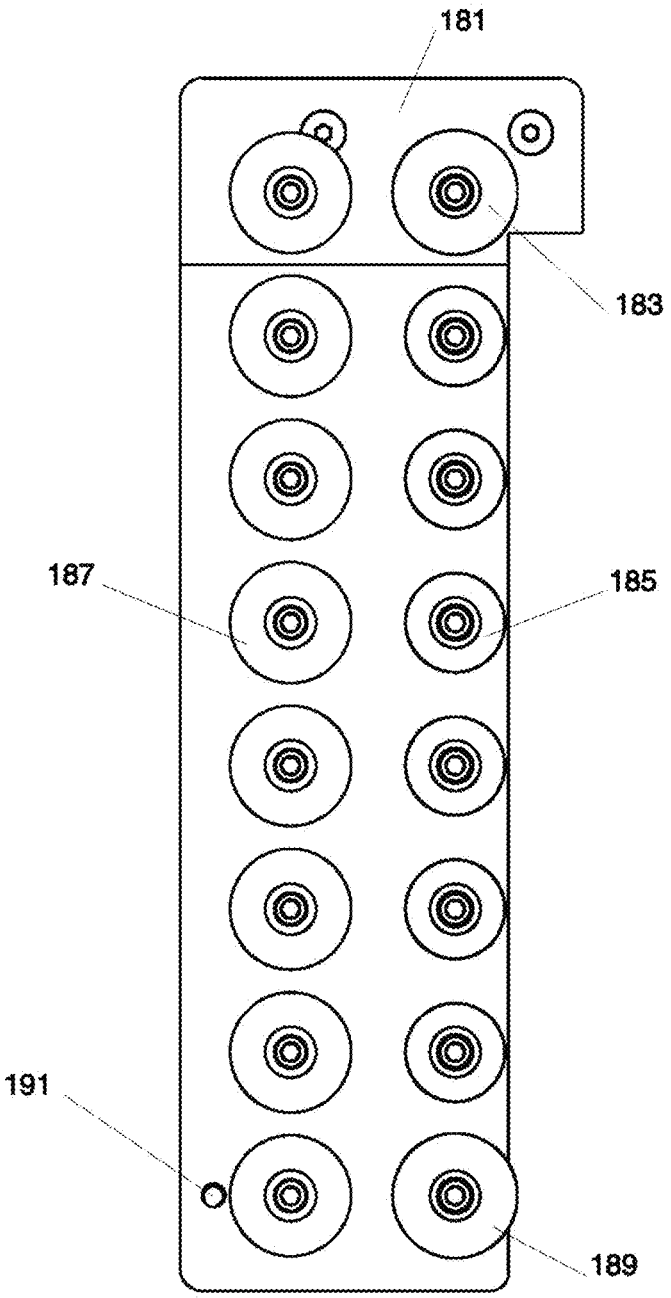
FIG. 11 is a front view of an embodiment of the plate assembly.
Figure 12:
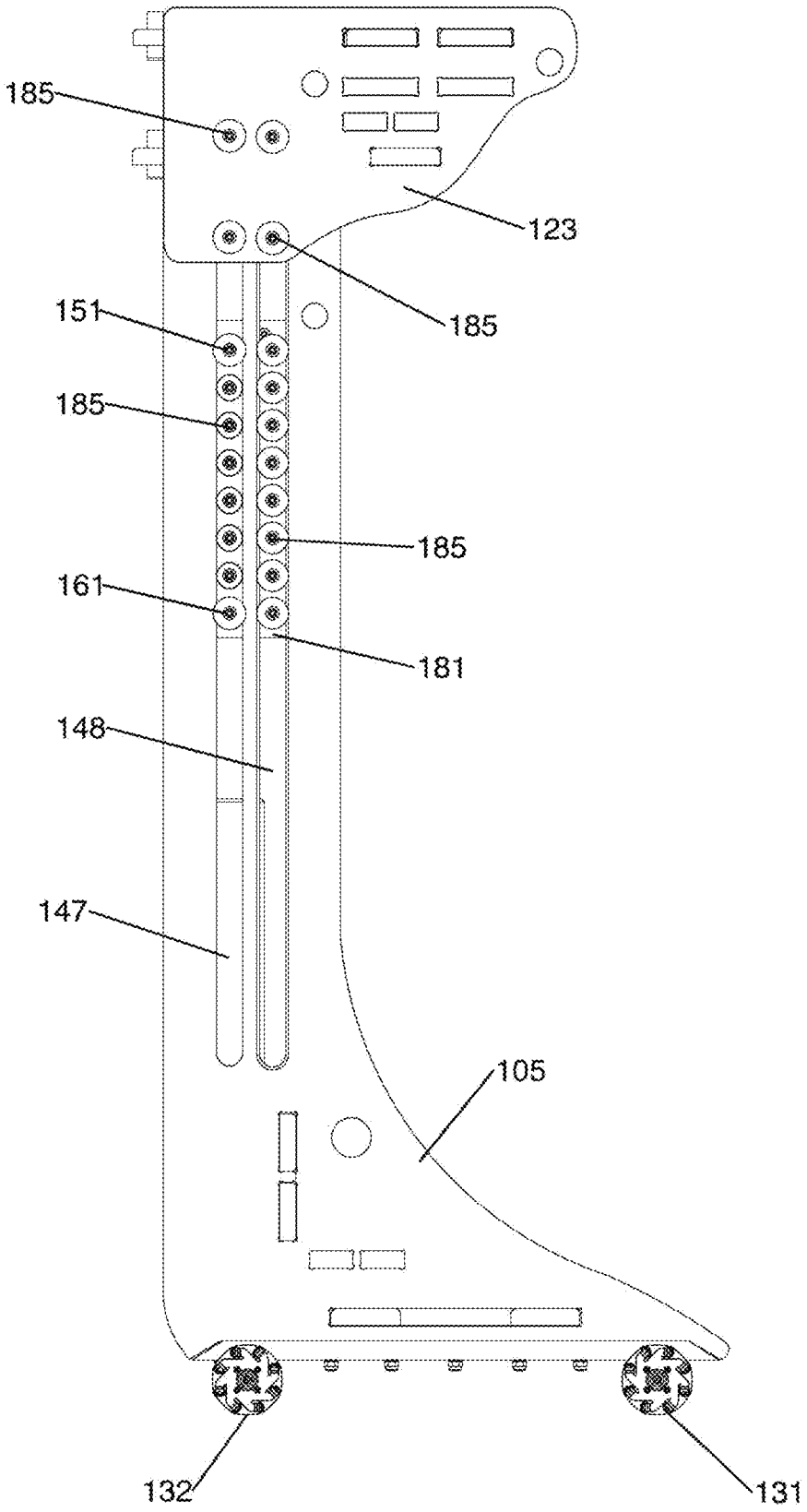
FIG. 12 is a side view of an embodiment of the adjustable desk invention with the desktop and the tilt plate removed.

FIG. 10 is a side view and FIG. 11 a front view of an embodiment of the double-rail system plate assembly 180, of the double-rail system plate assembly 180. In the illustrated embodiment, the double-rail system plate assembly 180 includes: a side plate 181, a pivot bearing 183, groove bearings 187, and an attachment bearing 189. FIG. 12, illustrates the vertical member 105 with the pivot bearing 183, groove bearings 187, and an attachment bearing 189 extending through the grooves 147, 148.

Each of the described pivot bearings 183 is attached to the tilt plate shown in the other drawings. The pivot bearing 183 extends through the pivot point in the tilt plate and the attachment bearing 189 extends through the arcuate slot in the tilt plate. The weight of the desktop and the tilt plates is supported by the pivot bearings 183 and the attachment bearings 189. The pivot bearing 183, the groove bearings 187, and the attachment bearing 189 also extend through the vertical grooves in the vertical members. The vertical and tilt actuators are also attached to the side plate 181. The tilt actuator is coupled between a coupling on a front portion of the tilt plate and the tilt actuator pivot 191. In the tilt actuator's extended position, the desktop can be horizontal and in the retracted position, the desktop can be angled downward. As the tilt actuators move between extended and retracted positions, the tilt actuators can freely rotate about the coupling on the front portion of the tilt plate and the tilt actuator pivot 191. The upper end of vertical actuator is coupled to the upper coupling. The pivot bearing 183, the groove bearings 187, and the attachment bearing 189 can be cylindrical in shape with a main portion that has a uniform diameter and an outer portion or middle portion that can have a wider diameter. These wider diameters can keep the pivot bearing 183, the groove bearings 187, and the attachment bearing 189 within the grooves 147, 148 or slots in the vertical member 105 and the tilt plates. The pivot bearing 183, the groove bearings 187, and the attachment bearing 189 can have smooth rolling bushings or bearings so that these components can slide smoothly within the grooves 147, 148 and slots of the vertical members and the tilt plates.

Figure 13:
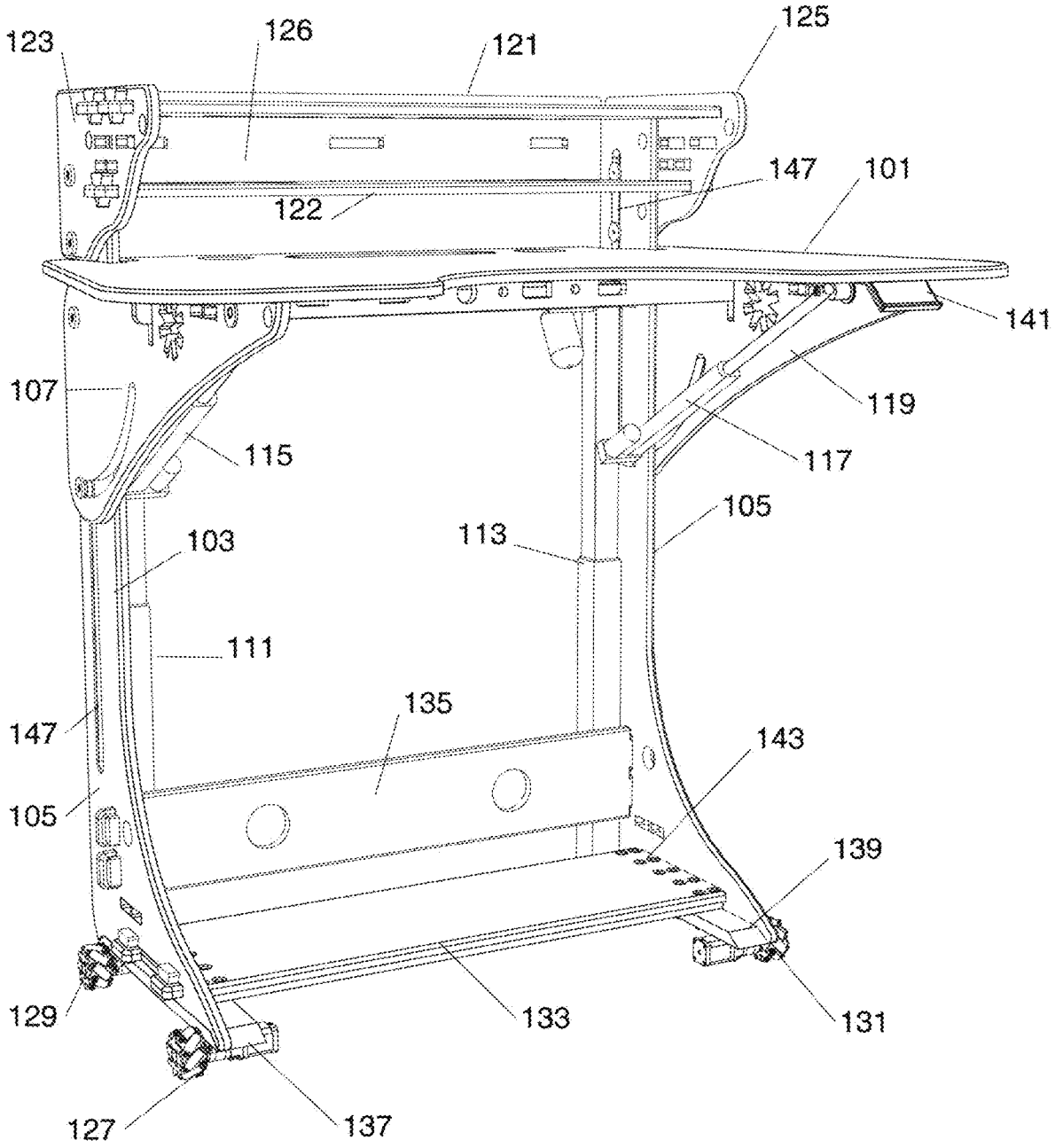
FIG. 13 is a front perspective view of an embodiment of the adjustable desk invention having a single groove in each vertical member.

With reference to FIG. 13, an embodiment of the inventive desk 100 is illustrated, similar to FIG. 1 but with only a first vertical slot in a first vertical member 105. As discussed, the pivot points and the bearing attachment points slide within the single vertical groove 147. In the illustrated embodiments, the vertical groove 147 is vertically oriented and therefore the pivot points and the attachment points can only move in vertical directions.

Figure 14:
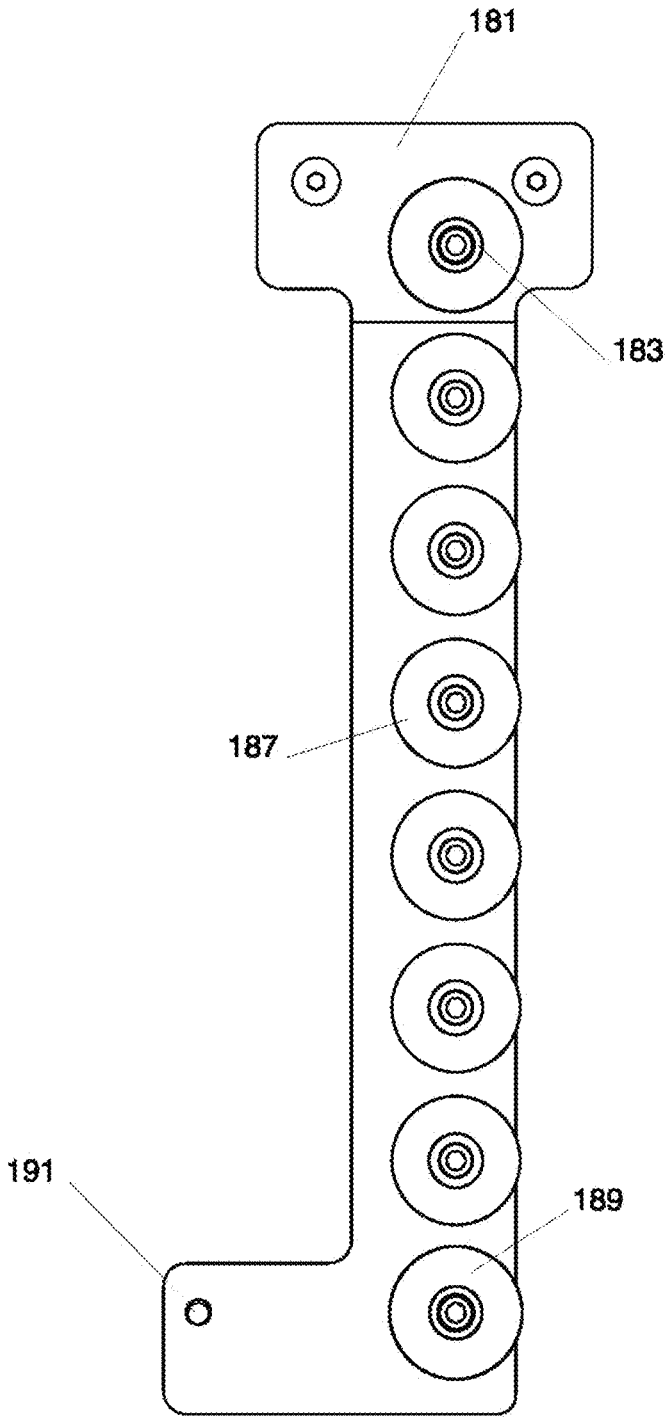
FIG. 14 is a front view of a single bearing row embodiment of the plate assembly.
Figure 15:
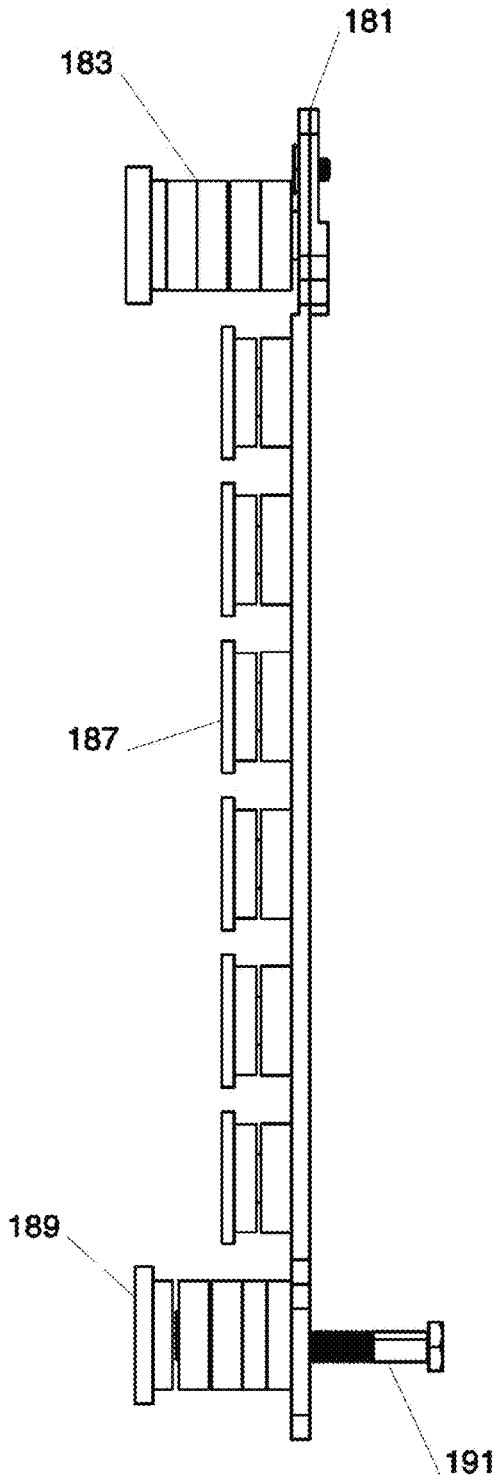
FIG. 15 is a side view of a single bearing row embodiment of the plate assembly.

FIG. 14 is a front view of an embodiment of the single-rail system plate assembly 180 to be used in the desk with only a first vertical slot in a first vertical member 105. FIG. 15 is a side view of an embodiment of the single-rail system plate assembly 180 to be used in the desk with only a first vertical slot in a first vertical member 105. The groove bearings 187 and the attachment bearing 189 extend through the vertical grooves in the vertical members. The vertical and tilt actuators are also attached to the side plate 181. The tilt actuator is coupled between a coupling on a front portion of the tilt plate and the tilt actuator pivot 191. In the tilt actuator's extended position, the desktop can be horizontal and in the retracted position, the desktop can be angled downward. As the tilt actuators move between extended and retracted positions, the tilt actuators can freely rotate about the coupling on the front portion of the tilt plate and the tilt actuator pivot 191.

Figure 16:
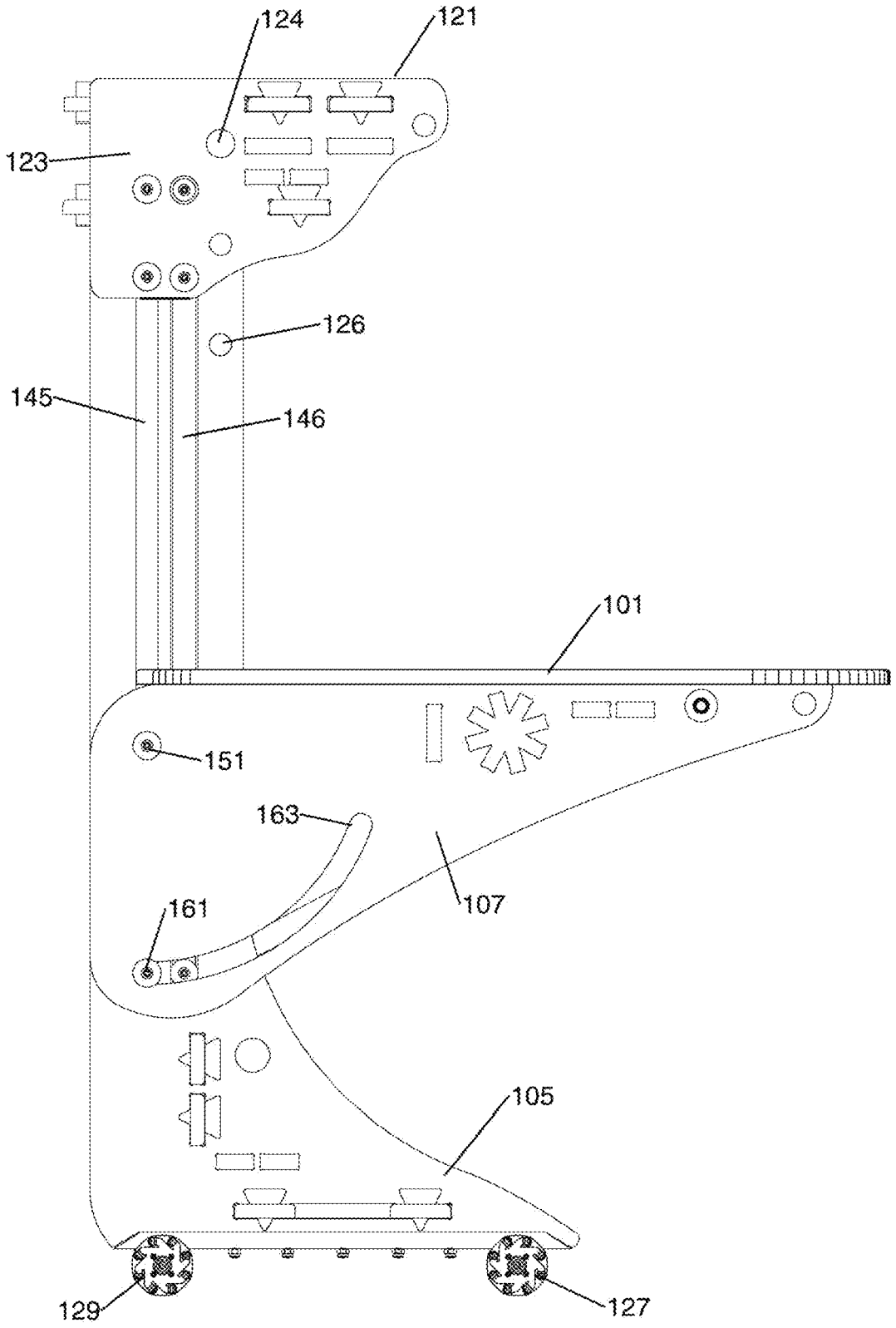
FIG. 16 is a left side view of an embodiment of the adjustable desk invention with the desktop in a horizontal and lowered position with the upper shelf assembly in a raised position.

FIG. 16 is a side view of an embodiment of the desk with the desktop 101 in a horizontal lowered position. The upper shelf assembly 121 can be locked in one of a plurality of raised positions at the upper portion of the vertical members. The upper shelf assembly 121 can be locked by a first bolt placed through a hole 124 in the first shelf side plate 123 and a hole 126 in the vertical member 105. As well as a second bolt placed through a hole in the second shelf side plate and a hole in the second vertical member. The vertical members can have a plurality of holes that can be used to adjust the position of the upper shelf assembly 121.

Figure 17:
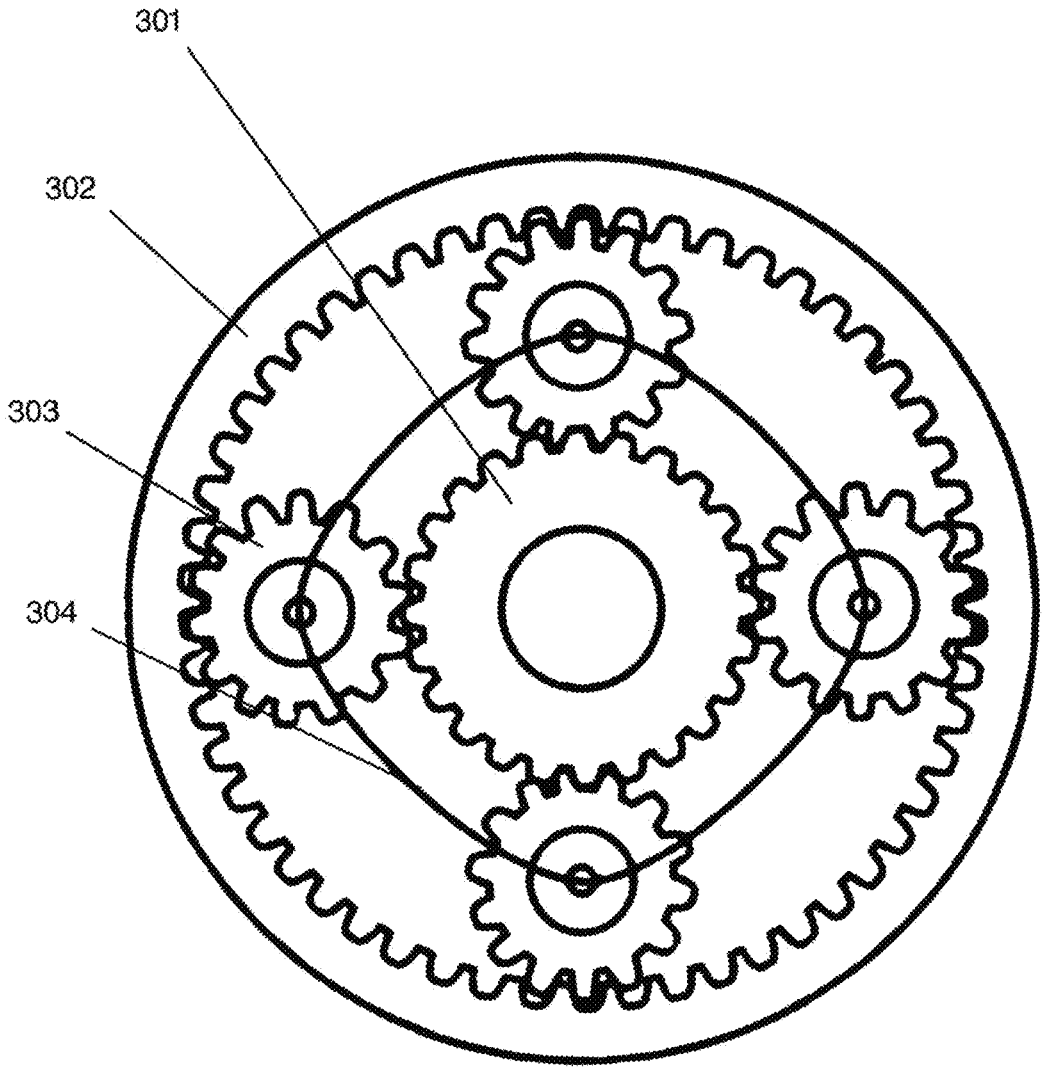
FIG. 17 shows an example of a planetary gearing used in an embodiment of the movable desk.

In an embodiment of the desk, the wheels 127, 129, 131, 132 are omnidirectional wheels. There can be four wheels in the embodiment. Each wheel 127, 129, 131, 132 is coupled to one motor 137 forming a wheel assembly. There can be four sets of wheel assemblies in the embodiment. Between each motor 137 and each omnidirectional wheel 127, 129, 131, 132, there can be a planetary gearing to increase the torque. FIG. 17 shows an example of a planetary gearing used in some embodiments of the movable desk 100. As shown in FIG. 17, the planetary gearing can have a sun gear 301, a ring gear 302, planet gears 303 and a carrier 304. In this example, there are four planet gears 303, which are meshed with the ring gear 302 and the sun gear 301. The ring gear 302 can be fixed. The carrier 304 connects the center of the four planet gears 303. An output shaft of the motor 137 can be connected to the center of the sun gear 301 and therefore cause the rotation of the sun gear 301. The rotation of the sun gear 301 further makes the planet gears 303 move along the inner rim of the ring gear 302 and thus makes the carrier 304 rotate around its central axis. The omnidirectional wheel 127, 129, 131, 132 can be connected to the center of the carrier 304, which transmits the rotation torque to the omnidirectional wheel 127, 129, 131, 132 and causes it to rotate. Due to the planetary gearing, the torque can be increased.

In a preferred embodiment, the omnidirectional wheels 127, 129, 131, 132 can be Mecanum wheels. The Mecanum wheel can make a land-based vehicle move in any direction. The Mecanum wheel is a form of tireless wheel, with a series of rubberized external rollers obliquely attached to the whole circumference of its rim. These rollers typically each have an axis of rotation at 45° to the wheel plane and at 45° to the axle line. Each Mecanum wheel is an independent non-steering drive wheel with its own powertrain, and when spinning generates a propelling force perpendicular to the roller axle, which can be vectored into a longitudinal and a transverse component in relation to the vehicle. FIGS. 18*a*-18*f* show the different movements of the desk mounted on a set of four Mecanum wheels. By controlling the rotation of each Mecanum wheel, the desk can move in various different directions. A rectangle 201 in the center indicates the movable desk and there are four Mecanum wheels 203 on the corners of the rectangle 201. The arrows beside the Mecanum wheels 203 can indicate wheel rotation directions, and the arrows on the rectangle indicate corresponding desk movement direction. In all examples, the rotating Mecanum wheels 203 all rotate at the same speed in the direction indicated by the adjacent arrow or the Mecanum wheels 203 is stopped and not rotating.

Figure 18A:
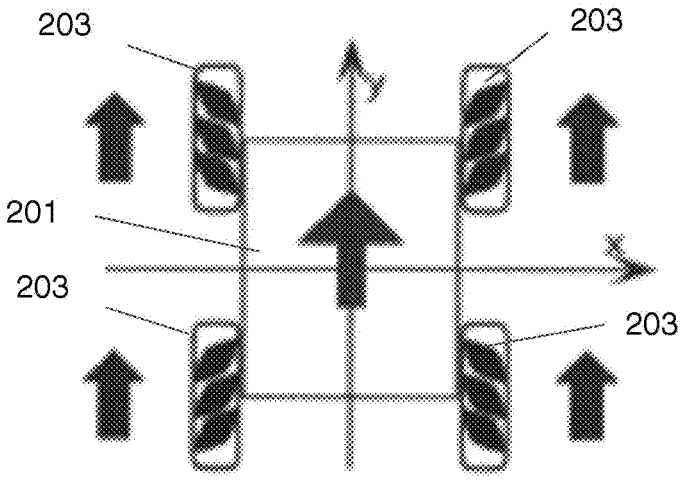
FIGS. 18*a*-18*f* are schematic diagrams showing movements of an omnidirectional wheel to various directions.
Figure 18B:
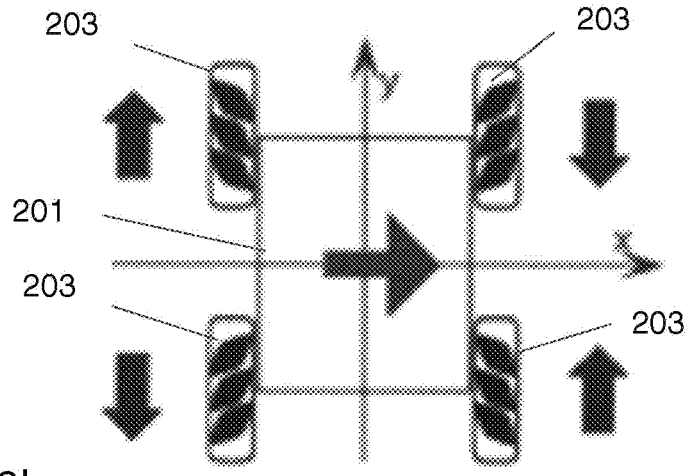
Figure 18C:
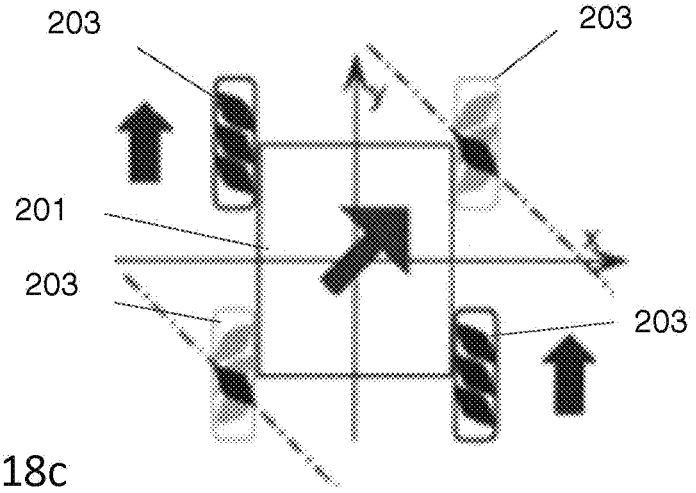
Figure 18D:
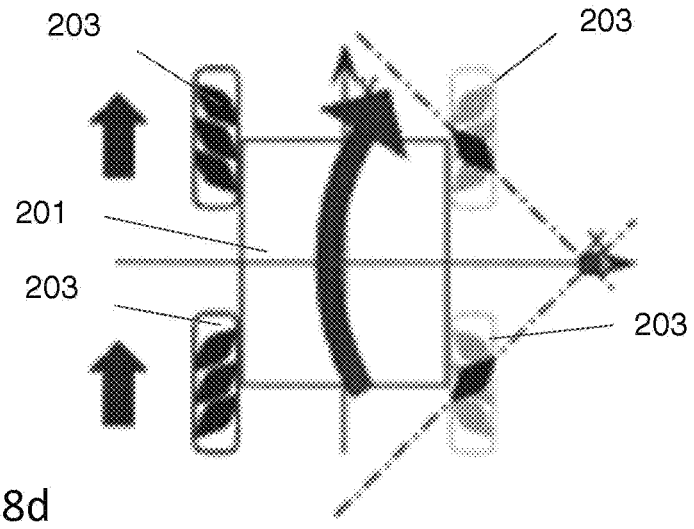
Figure 18E:
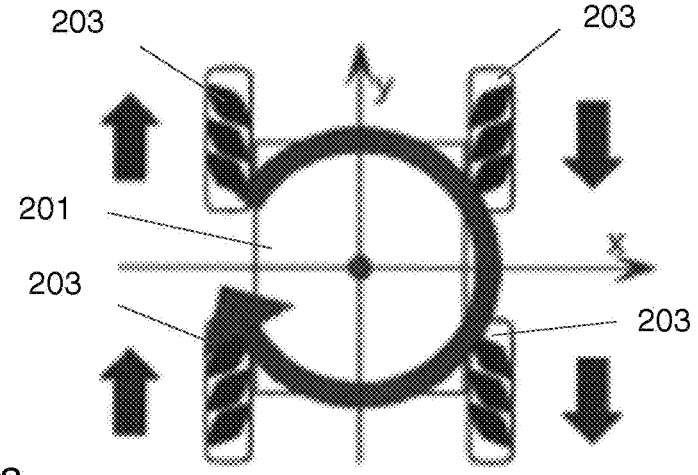
Figure 18F:
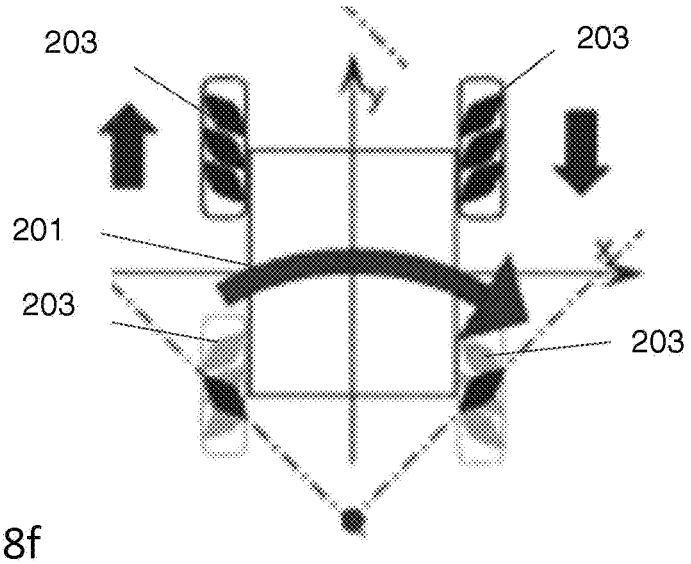

With reference to FIG. 18*a*, rotating all four Mecanum wheels 203 in the same direction and at the same speed will result in a forward/backward movement of the desk rectangle 201. As the longitudinal force vectors add up but the transverse vectors cancel each other out. With reference to FIG. 18*b*, a diagonal pair of Mecanum wheels 203 rotate in one direction while the other diagonal pair of Mecanum wheels 203 are rotated in the opposite direction will result in a sideways movement of the desk rectangle 201. With reference to FIG. 18*c*, a diagonal pair of Mecanum wheels 203 in one direction while the other diagonal pair of wheels 203 do not rotate which will result in a diagonal movement of the desk rectangle 201, since the transverse vectors and the longitudinal vectors combine to form the diagonal movement. With reference to FIG. 18*d*, the left-side pair of Mecanum wheels 203 rotate in one direction while the right-side pair of Mecanum wheels 203 do not rotate. This will cause the desk to rotate around a point of the transverse axis. With reference to FIG. 18*e*, both Mecanum wheels 203 on a left side of the desk rectangle 201 rotate in one direction while the two wheels 203 on the right side rotate in the opposite direction. This will result in a rotation about the center point of the desk rectangle 201, as the transverse vectors cancel out but the longitudinal vectors couple to generate a torque around the central vertical axis of the movable desk. With reference to FIG. 18*f*, the front-side pair of Mecanum wheels 203 rotate in opposite directions while the rear-side pair of Mecanum wheels 203 do not rotate. This will cause the desk to rotate around a point of the longitudinal axis. Controlling the rotations of the Mecanum wheels 203 will allow for desk motion in almost any desired direction with any rotation.

In an embodiment of the movable desk 100, the control unit 141 can have a controller 801, which can communicate with the vertical actuators 111, 113, the tilt actuators 115, 117 and the motors 137. The controller 801 can control movements of the vertical actuators 111, 113, the tilt actuators 115, 117 to adjust the vertical position and the tilt angle of the desktop 101. The controller 801 can control each of the four motors 137 of the wheel assemblies independently to achieve omnidirectional movements of the desk as illustrated in FIG. 18*a*-18*f*.

In an embodiment of the desk, the desk can have a memory 802 coupled to the controller 801. The memory 802 can store a predetermined desk location. The controller 801 can control the motors 137 of the wheel assemblies to move the desk from a current location to the predetermined desk location. The invention can use known indoor localization technology to localize or position the movable desk 100 in an indoor space. In some embodiments, the indoor position system can be used, which is based on beacons or tags that are installed in buildings or placed on tracked objects. Readers provided on the movable desks receive signals from these devices and send them to a server that processes the obtained data and directs the information with the exact coordinates to computer or mobile application. Such a solution makes it possible to build routes for moving the desks within the desk use area or space. In a preferred embodiment, the Ultra-Wideband (UWB) technology can be used to achieve more accurate localization and positioning.

Figure 19:
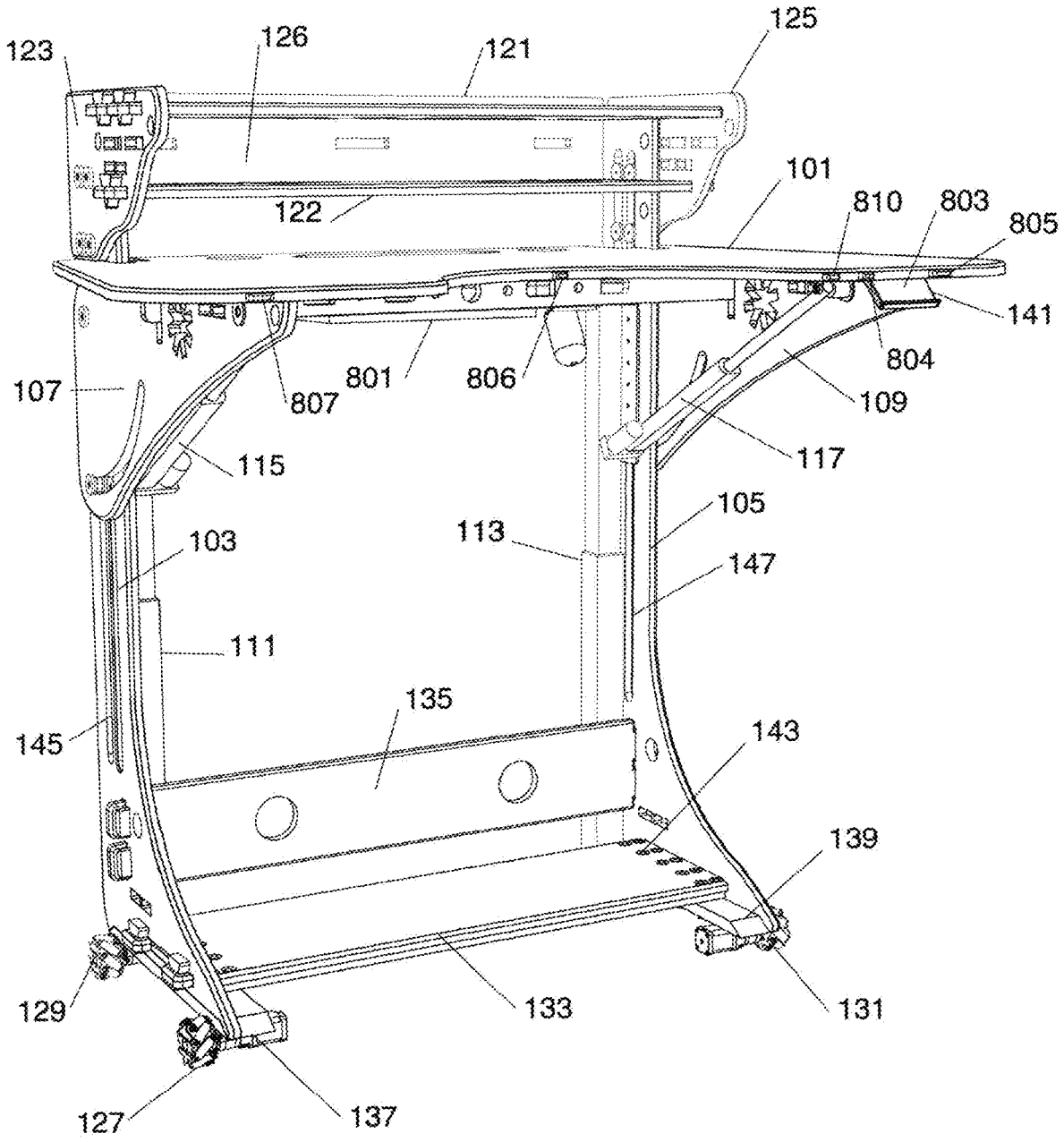
FIG. 19 is a front perspective view of an embodiment of the movable desk invention having a variety of components including a microphone, an object detection sensor, a camera, a user interface, a wireless receiver and a speaker.
Figure 22:
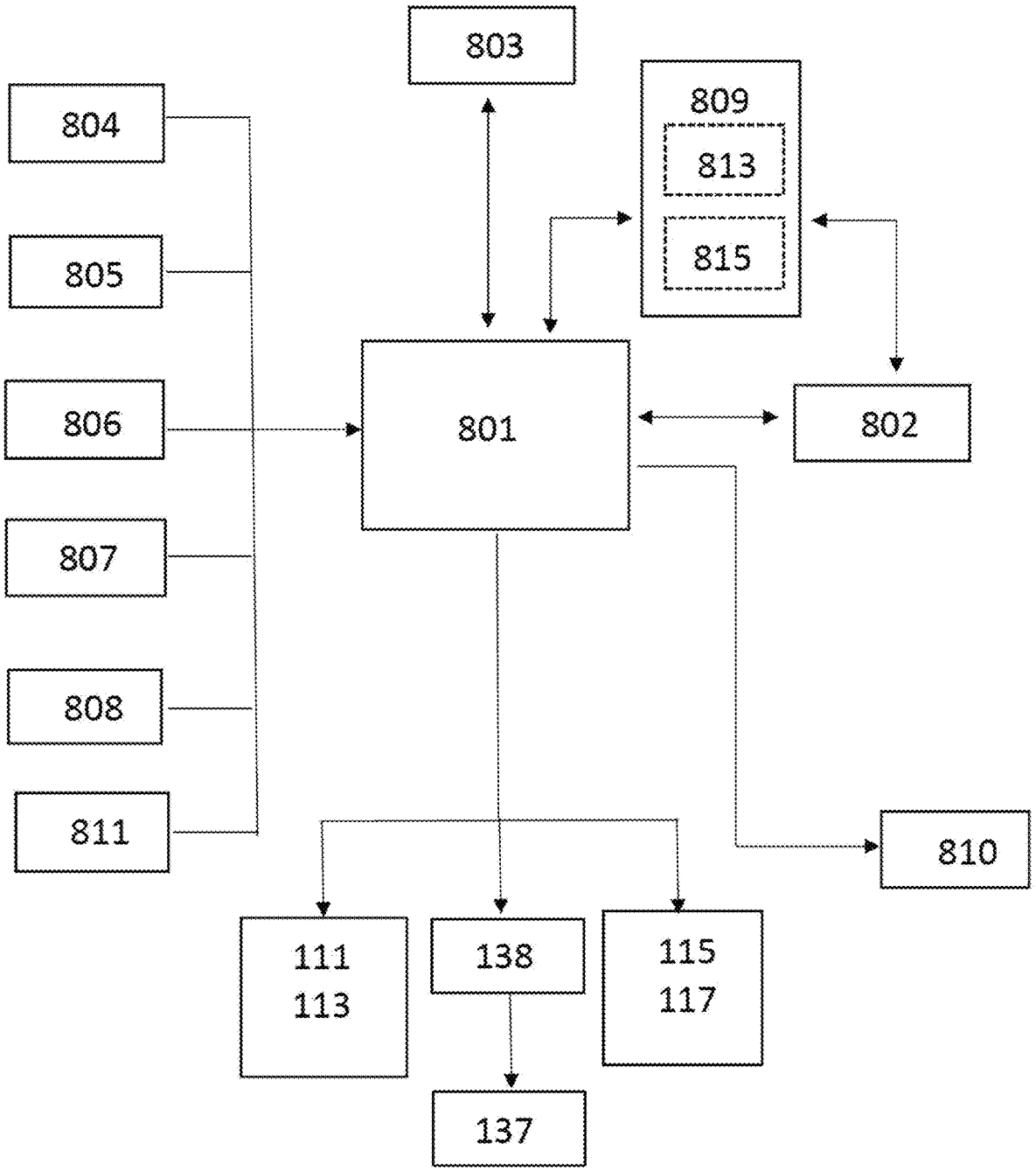
FIG. 22 is a schematic showing coupling ways of components of an embodiment of the movable desk.

As shown in FIG. 19, an embodiment of the movable desk invention can have a microphone 804 that can be positioned on a front portion adjacent to the desktop 101 so that it is normally in close proximity to the user. As shown in FIG. 22, the microphone 804 is coupled to the controller 801. The memory 802 can also store user preferences for the desk, such as desk location, height and tilt angle of the desktop, etc. There can be a voice-controlled command system running on the controller 801 for converting verbal commands received by the microphone 804 into languages recognized by the controller 801. The voice-user interface (VUI) technology can be used. In a preferred embodiment, the voice-controlled command system can be initially connected to an online AI platform such as OpenAI API and wherein a wide array of verbal commands is understood and processed. The voice-controlled command system can also be compatible with popular voice assistant systems like Amazon Alexa and Google Assistant, providing a seamless user experience across current and future smart ecosystems. The verbal commands can be user desired height or tilt angle of the desktop 101. The verbal commands can also be used to control the movement of the desk. The controller 801 controls the motors 137, the vertical actuators 111, 113 and the tilt actuators 115, 117 in response to the voice commands received by the microphone 804. The voice-controlled command system can recognize various voice commands. For example, the voice-controlled command system allows for:

- basic desk adjustments like "Lift" or "Raise," with options to specify the height as "Lift to X Height (in inches)" or "Lift by X Inches",
- surface angle adjustments, such as "Tilt Up," "Tilt Down," or "Tilt to X Degree", for rotational commands like "Rotate Left by X Degrees" or "Rotate Right by X Degrees",
- various movement commands, such as "Move Forward," "Move Backwards," "Move Horizontally Left," "Move Horizontally Right," and even diagonal movements like "Move Diagonally Backwards to the Left" or "Move Diagonally Forward to the Right",
- speed adjustments through "Increase Speed," "Decrease Speed," or specifically "Increase Speed by X Percent" and "Decrease Speed by X Percent", etc.
- mode selection commands, such as "Easel Mode", "Relax Mode", "Work Mode", etc.

As shown in FIG. 19, another embodiment of the movable desk invention can have an object detection sensor 805. The object detection sensor 805 can be provided near the front edge of the desktop. In a preferred embodiment, the object detection sensor 805 can be a photoelectric sensor, which can detect the presence of an object in a path of the movable desk 100 by using a light transmitter. There can be more than one object detection sensor so that the desk can avoid collisions while moving in any direction. In an embodiment, two object detection sensors 805 arranged at the two sides of the desktop near the front edge and/or object detection sensors 805 on the rear edge of the desktop. The object detection sensors 805 can be coupled to the controller 801, which responds to the object detected by one of the object detection sensors 805 in the path of the movable desk 100 by stopping the motors 137 or altering a course of the movable desk 100 to prevent a collision between the object and the movable desk 100.

As shown in FIG. 19, another embodiment of the movable desk invention can have a camera 806. The camera 806 can be provided on the front edge of the desktop 101. The camera 806 can also be provided on the upper transverse member 126 facing directly to a user standing or sitting in front of the desk 100. In an embodiment, the angle of the camera 806 can be adjustable. If the user is tall, the camera can automatically tilt up or be manually tilted up so that the camera has a full view of the user's face. Conversely, if the user is short, the camera can automatically tilt down or be manually tilted down so that the camera has a full view of the user's face. As shown in FIG. 22, the camera 806 is coupled to the controller 801. A facial recognition software can run on the controller 801. The memory 802 can also store facial image data of an authorized user of the movable desk. The camera 806 takes an image of a desk user's face and the facial recognition software determines that the image of the face matches the facial image data stored in memory 802 before the controller 801 allows the authorized user to control the movements of the vertical actuators 111, 113, the tilt actuators 115, 117 and the motors 137 of the wheel assemblies. If the image of a desk user's face does not match the desk can prevent the user from controlling the movement of the desk motors and actuators. In some embodiments, the camera 806 can also be used for detecting objects that are in the way of the moving desk to provide redundancy for safety in case of a failure of the object detection sensor 805.

Figure 20:
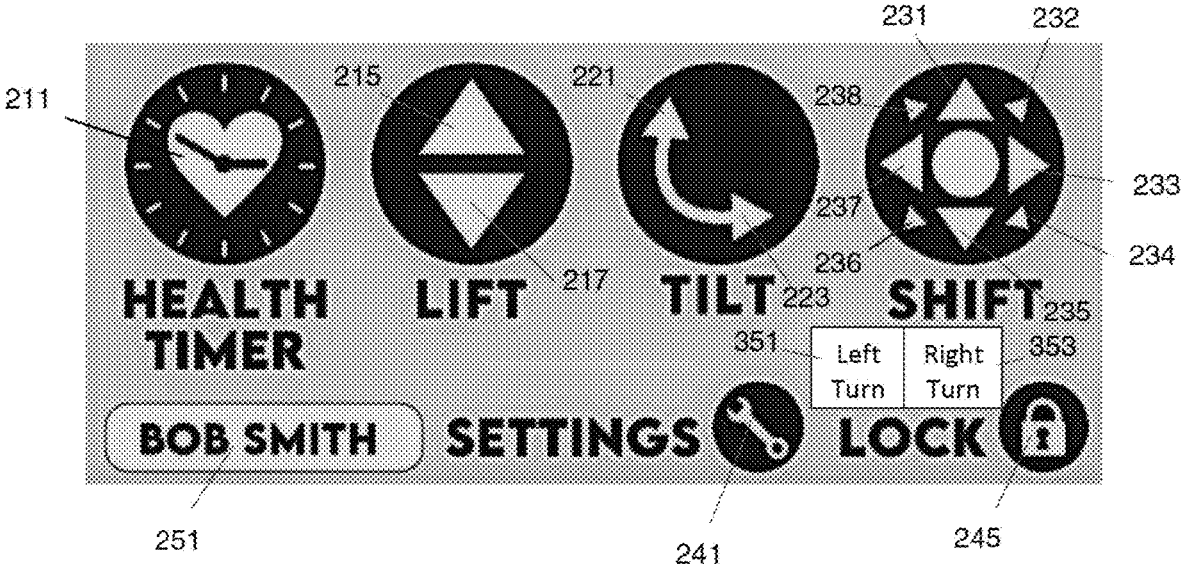
FIG. 20 shows an example of the UI layout of an embodiment of the movable desk.

As shown in FIG. 20, another embodiment of the movable desk invention can have a user interface. In this embodiment, the user interface 803 is a digital touchscreen touchpad. FIG. 20 shows an example of a "main menu" of UI layout for the touchpad or other UI device. The UI layout can include some function buttons like HEALTH TIMER 211, LIFT up 215, down 217, TILT up 221, down 223, SHIFT movement forward 231, forward/right 232, right 233, reverse/right 234, reverse 235, reverse/left 236, left 237, and forward/left 238. In some embodiments, the movement buttons can also include a left turn button 351 and a right turn button 353 that can allow the desk to rotate in a left and a right direction. The UI layout can also include SETTINGS 241 and LOCK 245 controls with corresponding icons. It can also show an authorized user's name 251 after the user has been identified by the system. The authorized user can operate the movable desk by touching the corresponding buttons. For example, if the user intends to adjust desk height, he/she can touch the LIFT up button 215 or lift down button 217. If the user wants to adjust the desktop angle, the user can touch the tilt up button 221 or the tilt down button 223. If the user wants to move the desk, the user can press the desired direction button for the shift movement. Alternatively, the user interface 803 can be one or more press buttons, a digital haptic touch screen, etc. The user interface 803 can be fixed on the desk 100. The user interface 803 is coupled to the controller 801. In some embodiments, an authorized user can input user parameter data through the user interface 803 like a desired desk location, height and tilt angle of the desktop 101. The controller 801 can control the movements of the vertical actuators 111, 113, the tilt actuators 115, 117 and the wheel assemblies in accordance with the parameter data input by the authorized user.

Figure 21:
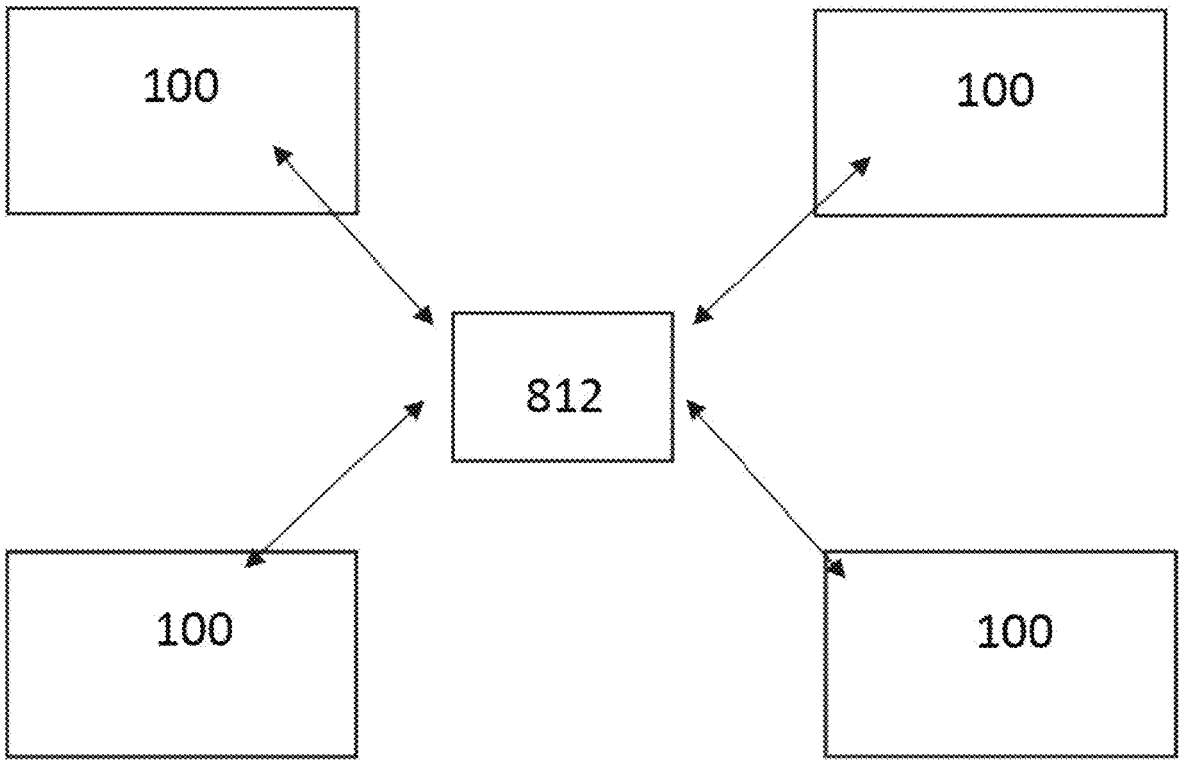
FIG. 21 shows a system for controlling a plurality of the movable desks.

As shown in FIG. 19, another embodiment of the movable desk invention can have a wireless receiver 807. The wireless receiver 807 is coupled to the controller 801 for providing wireless communications with a computing device 808 that is shown in FIG. 21. The computing device 808 can be a smartphone, pad, laptop etc. In the embodiment, the user interface is the screen of a smartphone. The smartphone communicates with the wireless receiver 807 on the desk 100 via Bluetooth, Wi-Fi or other suitable wireless protocols. The controller 801 can control the movements of the vertical actuators 111, 113, the tilt actuators 115, 117 and the motors 137 of the wheel assemblies in accordance with signals received by the wireless receiver 807 from the smartphone. FIG. 20 illustrates an embodiment of a UI that can be displayed on a remote computing device that be used to control the desk.

In an embodiment, the controller 801 can record desk setting data for an identified user. For example, a user may set up the desk with the user desired height, tilt, and locations on the work space and press a setting save button on the user interface so this desk setting data can be stored in the memory 802. The controller 801 can record the desk setting data for multiple users, and the memory 802 can store the desk setting data for multiple users accordingly. The desk setting data of each user comprises desk user identification, desktop height, desktop tilt angle, locations of the movable desk 100, and time of use for the movable desk 100. In a preferred embodiment, the movable desk 100 can have an artificial intelligence (AI) machine learning module 809, which is coupled to the controller 801 with access to the desk setting data stored in the memory 802. The AI machine learning module 809 can learn user habits through the desk setting data and generate suggested desk setting preferences. The user interface 803 can display the desk setting preferences for the identified user. There can be an accept button on the user interface 803 for accepting the desk setting preferences for the identified user. There can also be a desk setting modify button for controlling the vertical actuators 111, 113, the tilt actuators 115, 117 and the motors 137 of the movable desk 100. In some embodiments, the AI machine learning module 809 can be connected to an online AI platform like OpenAI API wherein it can integrate with the user's digital calendar. This allows the desk to automatically adjust settings based on scheduled activities like meetings, focused work sessions, or breaks. For instance, the movable desk 100 can automatically lower at lunchtime if it detects a scheduled lunch break on the calendar. In some embodiments, the AI machine learning module 809 can be trained to analyze ergonomic data and suggest when it's time to switch between sitting and standing, thereby promoting better posture and overall health. In some embodiments, the AI machine learning module 809 could provide weekly or monthly analytics reports on usage patterns, energy savings, and even health metrics, offering a comprehensive overview of users' workspace utilization.

As shown in FIG. 19, another embodiment of the movable desk invention can have a speaker 810. The speaker 810 is coupled to the controller 801. The movable desk 100 further comprises a sensor 811 for detecting that the user is in a seated position at the movable desk. In a preferred embodiment, the sensor 811 can be a photoelectric sensor, which can detect the absence of an object. The sensor 811 can be provided on the desk at the height where the sensor 811 detects the absence of a user when he/she is in a seated position. The sensor 811 is also coupled to the controller 801. When the user has remained in the seated position for a pre-determined time period such as 60 minutes determined by the controller 801, the controller 801 can cause the speaker 810 to give an audio reminder to move out of the seated position.

In another embodiment, the user interface 803 can be a user identification interface which is coupled to the controller 801 for recognizing authorized users. The user identification interface can be a radio frequency identification reader, a fingerprint reader, a retain scanner, and a facial recognition camera etc. The memory 802 stores user identification data and user preferences for movable desk settings for a plurality of authorized users. When a user's identification information like fingerprints matches the data of any user stored in the memory 802, the controller 801 controls the vertical position of the desktop 101 and adjusts the tilt angle of the desktop 101 to match the movable settings for the identified user from the plurality of users identified by data received by the controller 801. The user identification can also be used as a security user identification interface for preventing unauthorized use of the desk 100. When a user's identification information like fingerprints does not match the data of any user stored in the memory 802, the controller 801 can refuse to respond to prevent any adjustment or movement of the desk.

In an embodiment, the memory 802 can also store data of various operational modes for the movable desk. Each of the operational modes has different predetermined personalized movable desk settings, user restrictions, and desk control restrictions. For example, there can be a Standing Mode, which activates pre-set configurations for standing work, adjusting the desk to the user's preferred standing height;

there can be a Presentation Mode, which adjusts the desk's tilt and height for optimal viewing by a group of people, making it ideal for presentations or collaborative work; there can be a Work Mode, which adjusts the desk to the user's preferred height for general work, optimizing for comfort and productivity; there can be a Relax Mode, which lowers the desk to a more casual height, suitable for leisure activities like reading or enjoying a coffee break; there can be a Manual Mode allowing users to manually adjust the desk's height, tilt, and position according to their immediate needs; there can be an Auto Mode automatically adjusting the desk based on learned preferences and suggestions as described above, providing a tailored user experience that evolves over time; etc. The user interface 803 can have a management interface that is coupled to the controller 801 and the memory 802. The management interface can have access to the memory to select, modify, and customize the operational modes. The various operational modes can be activated by the user interface or voice command described above.

In an embodiment as shown in FIG. 21, multiple movable desks 100 and a central management computing device 812 can form a system that can be used to move the desks 100 in a coordinated manner. In the illustrated embodiment, there are four movable desks 100. In other embodiments, there can any number of the movable desks 100. In some embodiments, the central management computing device 812 can be a smartphone, a laptop, a pad, a desktop, etc. The central management computing device 812 can communicate with each movable desk 100 in the system via the wireless receiver 807 provided on each movable desk 100. The central management computing device 812 has a processor, a wireless transmitter, a command user interface and a management memory for storing a set of predetermined positions for each movable desk 100 in the system. In some embodiments, the operational modes can further include a Meeting Mode for enterprise settings, wherein the multiple movable desks 100 can automatically adjust to a meeting-friendly configuration, such as a circular or semi-circular layout; a Collaboration Mode wherein the multiple movable desks 100 can move closer together or adjust their heights to facilitate easier collaboration between team members working on a project; a Training Mode for educational settings or training sessions, which adjusts the multiple movable desks 100 to an optimal height and orientation for viewing presentations or participating in interactive lessons; etc. In some embodiments, the Meeting Mode for enterprise settings can be pre-scheduled to activate based on the office calendar or clock, ensuring that the workspace is always optimized for the planned activities.

When some or all of the desks 100 need to be moved to a storage area, the central management computing device 812 can transmit movement commands to move each movable desk 100 in the system. The central management computing device 812 can determine the locations of the desks 100 and then transmit movement commands to the desks 100. The central management computing device 812 can control the closest desk 100 to the storage area first and the subsequently control the next closest desk 100 to the storage area. By prioritizing the moving of the desk 100 that is closest to the storage area, there is less likelihood of having to avoid or move around another desk 100 to get to the storage area. Conversely, if the desks 100 need to be moved to an open work area where the desks 100 are separated from each other, the central management computing device 812 can control the closest desk 100 to the work area first and the subsequently control the next closest desk 100 to the work area. Again, by prioritizing the moving of the desk 100 that is closest to the work area, there is less likelihood of having to avoid or move around another desk 100 to get to the designated desk locations in the work area.

FIG. 22 shows how the computer components described above of an embodiment of the movable desk 100 are coupled with each other. The controller 801 can be a computer processor that is coupled to an electronic memory 802 and user interface 803 through which the user can transmit commands to the controller 801. As discussed above, the controller 801 can receive voice data from the microphone 804 interpret the voice data to determine the requested actions and actuate the actuators 111, 113, 115, 117 and/or motors 137 in accordance with the requested actions. As also discussed above, user image data from the camera 806 can be received by the controller 801 and compared to authorized image data of authorized users. If the image data matches the authorized image data, the controller 801 can allow the user to operate the actuators 111, 113, 115, 117 and/or motors 137. In some embodiments, each motor 137 can have a motor controller 138 that gets the signal from the controller 801 and rotates the motor 137 according to the commands received by the controller 801. As also discussed above, the wireless receiver 807 is coupled to the controller 801 for providing wireless communications with the computing device 808. As also discussed above, the AI machine learning module 809 coupled to the controller 801 can have access to the desk setting data stored in the memory 802. In some embodiments, the AI machine learning module 809 that connects to the controller 801 not only provides a dedicated machine learning processor 813 but also provides an encrypted crypto security chip 815 that prevents the user's data from being transferred over the network or stored in the memory 802. As also discussed above, the speaker 810 is coupled to the controller 801. The sensor 811 for detecting that the user is in a seated position is also coupled to the controller 801. When the user has remained in the seated position for a pre-determined time period determined by the controller 801, the controller 801 can cause the speaker 810 to give an audio reminder to move out of the seated position.

Figure 23:
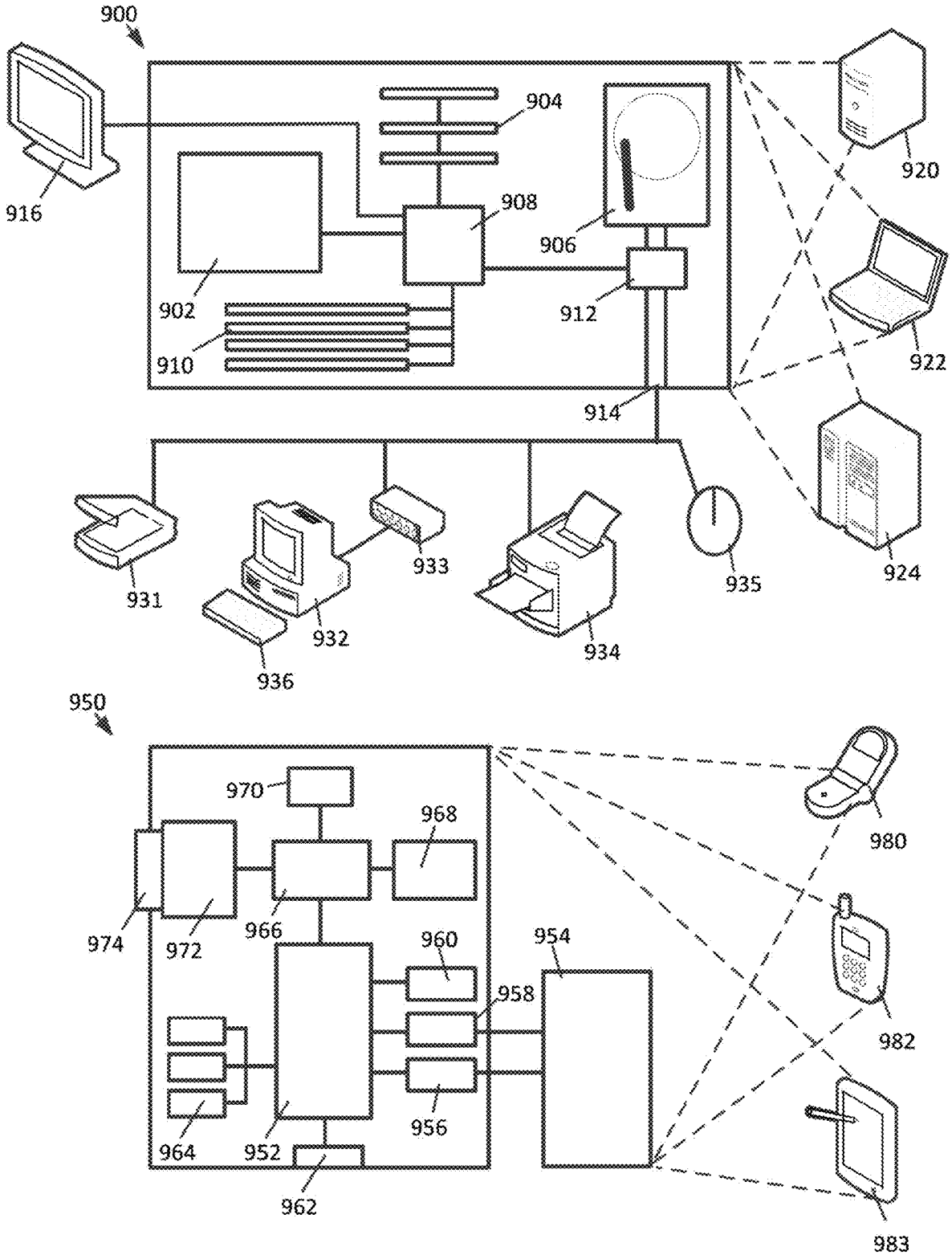
FIG. 23 shows an example of a generic computer device.

FIG. 23 shows an example of a generic computer device 900 and a generic mobile computer device 950, which may be used to implement the processes described herein, including the mobile-side and server-side processes for installing a computer program from a mobile device to a computer. Computing device 900 is intended to represent various forms of digital computers, such as laptops, desktops, workstations, personal digital assistants, servers, blade servers, mainframes, and other appropriate computers. Computing device 950 is intended to represent various forms of mobile devices, such as personal digital assistants, cellular telephones, smartphones, and other similar computing devices. The components shown here, their connections and relationships, and their functions, are meant to be exemplary only, and are not meant to limit implementations of the inventions described and/or claimed in this document.

Computing device 900 includes a processor 902, memory 904, a storage device 906, a high-speed interface 908 connecting to memory 904 and high-speed expansion ports 910, and a low speed interface 912 connecting to low speed bus 914 and storage device 906. Each of the components processor 902, memory 904, storage device 906, high-speed interface 908, high-speed expansion ports 910, and low speed interface 912 are interconnected using various busses, and may be mounted on a common motherboard or in other manners as appropriate. The processor 902 can process instructions for execution within the computing device 900, including instructions stored in the memory 904 or on the storage device 906 to display graphical information for a GUI on an external input/output device, such as display 916 coupled to high speed interface 908. In other implementations, multiple processors and/or multiple busses may be used, as appropriate, along with multiple memories and types of memory. Also, multiple computing devices 900 may be connected, with each device providing portions of the necessary operations (e.g., as a server bank, a group of blade servers, or a multi-processor system).

The memory 904 stores information within the computing device 900. In one implementation, the memory 904 is a volatile memory unit or units. In another implementation, the memory 904 is a non-volatile memory unit or units. The memory 904 may also be another form of computer-readable medium, such as a magnetic or optical disk.

The storage device 906 is capable of providing mass storage for the computing device 900. In one implementation, the storage device 906 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier may be a non-transitory computer- or machine-readable storage medium, such as the memory 904, the storage device 906, or memory on processor 902.

The high speed controller 908 manages bandwidth-intensive operations for the computing device 900, while the low speed controller 912 manages lower bandwidth-intensive operations. Such allocation of functions is exemplary only. In one implementation, the high-speed controller 908 is coupled to memory 904, display 916 (e.g., through a graphics processor or accelerator), and to high-speed expansion ports 910, which may accept various expansion cards (not shown). In the implementation, low-speed controller 912 is coupled to storage device 906 and low-speed expansion port 914. The low-speed expansion port 914, which may include various communication ports (e.g., USB, Bluetooth, Ethernet, wireless Ethernet), may be coupled to one or more input/output devices, such as a keyboard 936 in communication with a computer 932, a pointing device 935, a scanner 931, or a networking device 933 such as a switch or router, e.g., through a network adapter.

The computing device 900 may be implemented in a number of different forms, as shown in the figure. For example, it may be implemented as a standard server 920, or multiple times in a group of such servers. It may also be implemented as part of a rack server system 924. In addition, it may be implemented in a personal computer such as a laptop computer 922. Alternatively, components from computing device 900 may be combined with other components in a mobile device (not shown), such as device 950. Each of such devices may contain one or more of computing device 900, 950, and an entire system may be made up of multiple computing devices 900, 950 communicating with each other.

Computing device 950 includes a processor 952, memory 964, an input/output device such as a display 954, a communication interface 966, and a transceiver 968, among other components. The device 950 may also be provided with a storage device, such as a Microdrive, solid state memory or other device, to provide additional storage. Each of the components computing device 950, processor 952, memory 964, display 954, communication interface 966, and transceiver 968 are interconnected using various busses, and several of the components may be mounted on a common motherboard or in other manners as appropriate.

The processor 952 can execute instructions within the computing device 950, including instructions stored in the memory 964. The processor may be implemented as a chipset of chips that include separate and multiple analog and digital processors. The processor may provide, for example, for coordination of the other components of the device 950, such as control of user interfaces, applications run by device 950, and wireless communication by device 950.

Processor 952 may communicate with a user through control interface 958 and display interface 956 coupled to a display 954. The display 954 may be, for example, a TFT LCD (Thin-Film-Transistor Liquid Crystal Display) or an OLED (Organic Light Emitting Diode) display, or other appropriate display technology. The display interface 956 may comprise appropriate circuitry for driving the display 954 to present graphical and other information to a user. The control interface 958 may receive commands from a user and convert them for submission to the processor 952. In addition, an external interface 962 may be provided in communication with processor 952, so as to enable near area communication of device 950 with other devices. External interface 962 may provide, for example, for wired communication in some implementations, or for wireless communication in other implementations, and multiple interfaces may also be used.

The memory 964 stores information within the computing device 950. The memory 964 can be implemented as one or more of a computer-readable medium or media, a volatile memory unit or units, or a non-volatile memory unit or units. Expansion memory 974 may also be provided and connected to device 950 through expansion interface 972, which may include, for example, a SIMM (Single In Line Memory Module) card interface. Such expansion memory 974 may provide extra storage space for device 950, or may also store applications or other information for device 950. Specifically, expansion memory 974 may include instructions to carry out or supplement the processes described above, and may include secure information also. Thus, for example, expansion memory 974 may be provide as a security module for device 950, and may be programmed with instructions that permit secure use of device 950. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 964, expansion memory 974, memory on processor 952, or a propagated signal that may be received, for example, over transceiver 968 or external interface 962.

Device 950 may communicate wirelessly through communication interface 966, which may include digital signal processing circuitry where necessary. Communication interface 966 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 968. In addition, short-range communication may occur, such as using a Bluetooth, Wi-Fi, or other such transceiver (not shown). In addition, GPS (Global Positioning System) receiver module 970 may provide additional navigation- and location-related wireless data to device 950, which may be used as appropriate by applications running on device 950.

Device 950 may also communicate audibly using audio codec 960, which may receive spoken information from a user and convert it to usable digital information. Audio codec 960 may likewise generate audible sound for a user, such as through a speaker, e.g., in a handset of device 950. Such sound may include sound from voice telephone calls, may include recorded sound (e.g., voice messages, music files, etc.) and may also include sound generated by applications operating on device 950.

The computing device 950 may be implemented in a number of different forms, as shown in the figure. For example, it may be implemented as a cellular telephone 980. It may also be implemented as part of a smartphone 982, personal digital assistant, a tablet computer 983 or other similar mobile computing device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

The present disclosure, in various embodiments, includes components, methods, processes, systems, and/or apparatus substantially as depicted and described herein, including various embodiments, sub combinations, and subsets thereof. Those of skill in the art will understand how to make and use the present disclosure. The present disclosure, in various embodiments, includes providing devices and processes in the absence of items not depicted and/or described herein or in various embodiments hereof, including in the absence of such items as may have been used in previous devices or processes, e.g., for improving performance, achieving ease, and/or reducing cost of implementation. Rather, as the following claims reflect, inventive aspects lie in less than all features of any single foregoing disclosed embodiment.

What is claimed is:

1. A movable desk, comprising:

an adjustable desktop;

vertical support members coupled to the adjustable desktop;

a vertical actuator for adjusting a vertical position of the adjustable desktop;

wheel assemblies coupled to bottom portions of the vertical support members wherein each of the wheel assemblies comprises an omnidirectional wheel and a motor coupled to the omnidirectional wheel;

a controller in communication with the vertical actuator and the motors of the wheel assemblies for controlling movements of the vertical actuator and the wheel assemblies; and a memory coupled to the controller for storing a predetermined desk location;

wherein the controller controls the vertical actuator to adjust the vertical position of the desktop and the controller controls the motors of the wheel assemblies to move the movable desk from a current location to the predetermined desk location.

2. The movable desk of claim 1 further comprising:

a user interface coupled to the controller for receiving desk controls from an authorized user; and a tilt actuator coupled to the adjustable desktop and in communication with the controller;

wherein the user interface receives tilt angle inputs and the controller adjusts a tilt angle of the adjustable desktop.

3. The movable desk of claim 1 further comprising:

a microphone coupled to the controller;

a memory coupled to the controller for storing user preferences for the movable desk; and a voice-controlled command system running on the controller for converting verbal commands received by the microphone into movement controls for the motors, wherein the movable desk is moved by the controller in response to voice commands received by the microphone.

4. The movable desk of claim 1 further comprising:

an object detection sensor coupled to the controller for detecting an object in a path of the movable desk, wherein the controller responds to the object in the path of the movable desk by stopping the motors or altering a course of the movable desk to prevent a collision between the object and the movable desk.

5. The movable desk of claim 1 wherein each of the wheel assemblies include a planetary gearing between the motor and the omnidirectional wheel.

6. The movable desk of claim 1 further comprising:

a camera coupled to the controller; and facial recognition software running on the controller;

wherein the memory coupled to the controller stores facial image data of an authorized user of the movable desk, the camera takes an image of a desk user's face and the facial recognition software determines that the image of the face matches the facial image data before the controller allows the authorized user to control the movements of the vertical actuator and the wheel assemblies.

7. The movable desk of claim 1 further comprising:

a user interface coupled to the controller, wherein the user interface is a digital touchscreen touchpad, a press button, and a digital haptic touch screen.

8. The movable desk of claim 1 further comprising:

a wireless receiver coupled to the controller for providing wireless communications with a computing device; and a user interface for controlling the movable desk running on the computing device;

wherein the user interface receives desk movement signals from the computing device and the controller controls the motors and the vertical actuator in accordance with the desk movement signals.

9. The movable desk of claim 1 further comprising:

desk setting data recorded by the controller and stored in the memory for a first identified user, wherein the desk setting data comprises: desk user identification, desktop height, desktop tilt angle, locations of the movable desk, and time of use for the movable desk;

an artificial intelligence (AI) machine learning module coupled to the controller having access to the desk setting data stored in the memory, wherein the AI machine learning module learns user habits through the desk setting data and generates desk setting preferences; and a user interface display coupled to the controller, wherein the user interface display displays the desk setting preferences for the first identified user, an accept button for accepting the desk setting preferences for the first identified user, and a desk setting modify button for controlling the vertical actuator and the motors of the moveable desk.

10. The movable desk of claim 9 further comprising:

desk setting data recorded by the controller and stored in the memory for a second identified user;

wherein the user interface display displays the desk setting preferences for the second identified user and an accept button for accepting the desk setting preferences for the second identified user.

11. The movable desk of claim 10 further comprising:

a speaker coupled to the controller; and a sensor for detecting that the user is in a seated position at the movable desk;

wherein the controller determines that the user has remained in the seated position for a pre-determined time period and the controller causes the speaker to give an audio reminder to move out of the seated position.

12. The movable desk of claim 1 further comprising:

a security user interface coupled to the controller for preventing unauthorized use of the desk wherein the security user interface comprising at least one of: a radio frequency identification reader, a fingerprint reader, a retina scanner, and a facial recognition camera.

13. A movable desk, comprising:

an adjustable desktop;

vertical support members coupled to the adjustable desktop;

a vertical actuator for adjusting a vertical position of the adjustable desktop;

wheel assemblies coupled to bottom portions of the vertical support members wherein each of the wheel assemblies comprises an omnidirectional wheel and a motor coupled to the omnidirectional wheel;

a controller in communication with the vertical actuator and the motors of the wheel assemblies for controlling movements of the vertical actuator and the wheel assemblies;

a tilt actuator for adjusting a tilt angle of the adjustable desktop, wherein the tilt actuator is extendable between an extended position and a retracted position;

a controller for controlling movements of the vertical actuator and the motors of the wheel assemblies;

a memory coupled to the controller for storing user preferences for movable desk settings for a plurality of users; and a user identification interface coupled to the controller, wherein the controller controls the vertical actuator to adjust the vertical position of the adjustable desktop and adjusts the tilt actuator to adjust the tilt angle of the adjustable desktop to match the movable desk settings for a user from the plurality of users identified by data received by the controller from the user identification interface.

14. The movable desk of claim 13, further comprising:

object detection sensors coupled to the controller for detecting objects close to the movable desk and preventing collisions between the objects and the movable desk.

15. The movable desk of claim 13, further comprising:

operational modes for the movable desk stored in the memory, wherein each of the operational modes has different predetermined personalized movable desk settings, user restrictions, and desk control restrictions; and a management interface coupled to the controller and the memory, wherein the management interface having access to the memory for selecting, modifying, and customizing the operational modes.

16. A system for controlling a plurality of movable desks, comprising:

a first desk of the plurality of movable desks comprising:

an adjustable desktop;

vertical support members coupled to the adjustable desktop;

a vertical actuator for adjusting a vertical position of the adjustable desktop;

wheel assemblies coupled to bottom portions of the vertical support members wherein each of the wheel assemblies comprises an omnidirectional wheel and a motor coupled to the omnidirectional wheel;

a controller in communication with the vertical actuator and the motors of the wheel assemblies for controlling movements of the vertical actuator and the wheel assemblies;

a wireless receiver in communication with the controller for receiving movement commands, and a memory coupled to the controller for storing a predetermined desk location;

wherein the controller controls the vertical actuator to adjust the vertical position of the desktop and the controller controls the motors of the wheel assemblies to move the movable desk from a current location to the predetermined desk location; and a central management computing device in wireless communication with the first movable desk, wherein the central management computing device has a processor, a wireless transmitter, a management memory for storing a set of predetermined positions for the first movable desk, and a command user interface, the central management computing device transmitting the movement commands to move the first desk to the predetermined positions.

17. The system for controlling a plurality of movable desks of claim 16 wherein the first desk further comprises an object detection sensor for detecting objects close to the first movable desk and the controller responds to the object in the path of the movable desk by stopping the motors or altering a course of the movable desk to prevent a collision between the object and the movable desk.

18. The array of movable desks of claim 16 wherein the management memory stores pre-defined user profile data for a plurality of users and the controller of the first movable desk receives the user profile data for one of the plurality of users and controls the vertical position of the adjustable desktop and adjusts the tilt angle of the adjustable desktop according to the user profile data.

19. The system for controlling a plurality of movable desks of claim 16 wherein the first desk further comprises a tilt actuator coupled to the adjustable desktop and in communication with the controller that receives tilt angle inputs and adjusts a tilt angle of the adjustable desktop.

20. The system for controlling a plurality of movable desks of claim 16 wherein the first desk further comprises: a camera coupled to the controller and facial recognition software running on the controller, wherein the memory coupled to the controller stores facial image data of an authorized user of the movable desk, the camera takes an image of a desk user's face and the facial recognition software determines that the image of the face matches the facial image data before the controller allows the authorized user to control the movements of the vertical actuator and the wheel assemblies.

* * * * *